US010718579B2

(12) United States Patent
Barrett et al.

(10) Patent No.: US 10,718,579 B2
(45) Date of Patent: Jul. 21, 2020

(54) MACHINE GUN BARREL ASSEMBLY

(71) Applicant: WHG Properties, LLC, North Wales, PA (US)

(72) Inventors: Ronnie Barrett, Murfreesboro, TN (US); Christopher Gene Barrett, Murfreesboro, TN (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/209,527

(22) Filed: Dec. 4, 2018

(65) Prior Publication Data

US 2019/0360771 A1 Nov. 28, 2019

Related U.S. Application Data

(63) Continuation of application No. 15/086,876, filed on Mar. 31, 2016, now Pat. No. 10,145,631, which is a continuation-in-part of application No. 14/823,110, filed on Aug. 11, 2015, now Pat. No. 10,006,727.

(60) Provisional application No. 62/062,141, filed on Oct. 9, 2014, provisional application No. 62/062,143, filed on Oct. 9, 2014, provisional application No. 62/036,096, filed on Aug. 11, 2014.

(51) Int. Cl.

| | |
|---|---|
| ***F41A 3/66*** | (2006.01) |
| ***F41A 19/10*** | (2006.01) |
| ***F41G 11/00*** | (2006.01) |
| ***F41A 3/72*** | (2006.01) |
| ***F41A 5/18*** | (2006.01) |

(52) U.S. Cl.

CPC *F41A 3/66* (2013.01); *F41A 3/72* (2013.01); *F41A 5/18* (2013.01); *F41A 19/10* (2013.01); *F41G 11/003* (2013.01)

(58) Field of Classification Search

CPC .... F41A 3/66; F41A 3/72; F41A 11/02; F41A 15/12; F41A 19/10; F41A 19/09; F41A 19/15; F41A 5/18; F41C 23/20; F41G 11/003

USPC ..... 89/136, 160, 168, 170, 159, 156, 177; 42/79

See application file for complete search history.

(56) References Cited

U.S. PATENT DOCUMENTS

| | | | |
|---|---|---|---|
| 2,088,268 | A | 7/1937 | Lauf |
| 2,131,716 | A | 9/1938 | Browning |
| 3,731,588 | A | 5/1973 | Curtis et al. |

(Continued)

FOREIGN PATENT DOCUMENTS

| | | | |
|---|---|---|---|
| GB | 1356222 | A | 6/1974 |
| WO | 2004068057 | A1 | 8/2004 |

OTHER PUBLICATIONS

European Patent Office Search Report for corresponding EP 16 83 5557, dated Jun. 17, 2019, 14 pages.

*Primary Examiner* — John Cooper
(74) *Attorney, Agent, or Firm* — Fox Rothschild LLP

(57) ABSTRACT

An M240 machine gun barrel assembly with a barrel with a muzzle end at the distal end of the barrel and a breach end at the proximal end of the barrel; a handle connector connecting the barrel to a handle assembly; and the handle assembly having a free end and a connected end, the connected end operably connected to the handle connector; the handle assembly operable between a first position with the free end of the handle assembly pointing proximally and a second position with the free end of the handle assembly pointing distally.

5 Claims, 44 Drawing Sheets

(56) References Cited

U.S. PATENT DOCUMENTS

| | | | | |
|---|---|---|---|---|
| 3,999,461 | A | 12/1976 | Johnson et al. | |
| 4,601,123 | A | 7/1986 | Swearengen et al. | |
| 4,651,455 | A | 3/1987 | Geiser | |
| 4,677,781 | A | 7/1987 | Lee | |
| 4,869,008 | A | 9/1989 | Rasmussen | |
| 6,250,194 | B1 | 6/2001 | Brandl et al. | |
| 7,356,958 | B2 | 4/2008 | Weir | |
| 7,937,877 | B2 | 5/2011 | Barrett | |
| 8,615,915 | B2 | 12/2013 | Hunter et al. | |
| 8,782,940 | B1 | 7/2014 | Morris | |
| 8,806,799 | B1 * | 8/2014 | Gordon | F41G 1/01 42/130 |
| 9,015,981 | B2 | 4/2015 | Zamlinsky | |
| 9,347,725 | B2 | 5/2016 | McAlister | |
| 9,441,899 | B2 | 9/2016 | Micklethwaite | |
| D799,629 | S | 10/2017 | Barrett | |
| 2006/0048426 | A1 | 3/2006 | Crandall | |
| 2008/0134557 | A1 | 6/2008 | Wossner et al. | |
| 2008/0216375 | A1 | 9/2008 | Barrett | |
| 2010/0037505 | A1 | 2/2010 | Romer | |
| 2011/0168008 | A1 | 7/2011 | Landies et al. | |
| 2011/0179945 | A1 * | 7/2011 | Clark | F41A 5/18 89/193 |
| 2011/0271827 | A1 * | 11/2011 | Larson | F41A 3/66 89/193 |
| 2011/0283582 | A1 | 11/2011 | Hunter et al. | |
| 2012/0144985 | A1 | 6/2012 | Beville et al. | |
| 2012/0167433 | A1 * | 7/2012 | Robbins | F41A 3/66 42/75.02 |
| 2012/0167757 | A1 * | 7/2012 | Gomez | F41A 5/28 89/193 |
| 2012/0180365 | A1 | 7/2012 | Savoy et al. | |
| 2012/0317860 | A1 * | 12/2012 | Langevin | F41A 5/28 42/111 |
| 2013/0185975 | A1 | 7/2013 | Johnson | |
| 2013/0269510 | A1 * | 10/2013 | Sullivan | F41A 5/26 89/193 |
| 2014/0075817 | A1 * | 3/2014 | Gomez | F41A 21/48 42/75.02 |
| 2015/0020429 | A1 | 1/2015 | Savoy et al. | |
| 2015/0143682 | A1 | 5/2015 | Gordon | |
| 2015/0338181 | A1 | 11/2015 | McAlister | |
| 2016/0305725 | A1 * | 10/2016 | Patel | F41A 11/02 |
| 2016/0348990 | A1 * | 12/2016 | Steil | F41G 1/033 |
| 2020/0025498 | A1 * | 1/2020 | Wheeler | F41A 21/325 |

* cited by examiner

MACHINE GUN BARREL ASSEMBLY

CROSS-REFERENCES TO RELATED APPLICATIONS

This application is a continuation-in-part application, claiming benefit of U.S. Nonprovisional patent application Ser. No. 14/823,110, for a Firearm System, filed on Aug. 11, 2015, which claims priority to U.S. Provisional Patent Application No. 62/062,141, filed on Oct. 9, 2014, for Firearm and Adapter; U.S. Provisional Patent Application No. 62/062,143, filed on Oct. 9, 2014, for Handguard for a Firearm; and U.S. Provisional Patent Application No. 62/036,096, filed on Aug. 11, 2014, for Firearm and Adapter, all of which are hereby incorporated by reference in their entireties.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to firearms, specifically the M240 machine gun and variants thereof. More particularly, the invention pertains to an adapter for the M240 machine gun so as to increase the mobility and usability of the firearm. Optionally, an adapter may be utilized on the bottom side of the receiver to move both the trigger and grip forward, closer to the muzzle of the firearm, so that a shorter overall length can be achieved. In some optional embodiments, the M240 machine gun may include an adapter that replaces the floor of the receiver or alternatively, in further optional embodiments, the M240 machine gun may include a trigger assembly with a proximal leg that engages the traditional trigger housing assembly engagement of the receiver of the M240 machine gun.

The M240 machine gun has generally been used by the United States military since at least about the late 1970's. Currently, the firearm has multiple applications being used by both infantry as well as with vehicles, both on land and on water. In use, the M240 machine gun is often fired from an integrated bipod or from a mount that may be attached to a vehicle or a fixed location. While not the lightest machine gun in use, the firearm is very reliable and relatively standardized among the NATO countries.

Historically, the M240 machine gun was modeled after features of the Browning machine gun of 1919 and the Browning automatic rifle of 1918. Through this thinking, the M240 developed with a box-type receiver with the shoulder stock placed on the rear of the receiver. As such, the trigger location is very near the end of the stock of the firearm. Otherwise stated, the M240 machine gun provides its grip at about the rearmost portion of the bottom of the receiver near where the stock connects to the receiver of the firearm. The stock must extend from the rear of the receiver of the M240 machine gun a significant length so as to provide an appropriate length of pull. Generally, the length of pull is based on about the average person's length of pull measured from their bent trigger finger to the person's bend in their arm. With the design of the M240 machine gun, the stock must provide the great majority of the length of pull as the grip and trigger are so near the rear of the receiver of the firearm.

Unfortunately, this design of the M240 machine gun provides unnecessary length and weight to the firearm making it more cumbersome than necessary. Thus, existing M240 machine guns can be difficult to transport by an individual, especially as it must often be carried into combat situations. What is desired therefore is an M240 machine gun having a more ergonomic shape and possibly decreased weight, wherein the trigger and grip are moved distally toward the muzzle of the firearm so that a shorter stock may be used with the M240 machine gun.

BRIEF SUMMARY OF THE INVENTION

As used herein, "proximal" refers to a longitudinal direction closer to the butt stock of the firearm than the muzzle of the firearm, and "distal" refers to a longitudinal direction closer to the muzzle of the firearm than the buttstock of the firearm. When "proximally" is used herein to describe the relationship between parts, the term denotes that the part located proximally is closer to the butt stock than the other part. When "distally" is used herein to describe the relationship between parts, the term denotes that the part located distally is closer to the muzzle than the other part.

Also as used herein, M240 refers to the family of belt-fed, gas operated machine guns which generally fire the 7.62×51 mm NATO cartridge. Further as used herein, the term "M240" is generally synonymous with the Belgian FN MAG58 machine gun and is used to include variants. Variants of the M240 machine gun may include but are not limited to the M240B, M240C, M240D, M240G, M24011, M240L, M240E1 and E5, M240L, and M240LW. While discussions of various optional embodiments may describe specific variants of the M240 machine gun, the use of "M240" is intended to include all variants so long as feasible, including when also present in the claims. Also, to the extent semi-automatic versions and/or single shot variants of the M240 machine gun exist, the use of "M240" is intended to include these variants so long as feasible.

As additionally used herein, the term "adapter" and "interface" may be used interchangeably and refer to optional embodiments of the invention which allow for the trigger housing assembly to be moved distally forward to provide for a more ergonomic and shorter M240 machine gun. In optional embodiments, the adapter may be used with an existing receiver for an M240 machine gun, replacing the bottom plate of the receiver.

In accordance with one optional aspect, an adapter for an M240 machine gun has a proximal end and a distal end and is connectable to an M240 machine gun receiver to replace the receiver floor of the M240 machine gun receiver; the adapter also having an ejection port, trigger housing assembly engagement, trigger opening, and receiver floor wall. The ejection port may be located at about the distal end of the adapter and the trigger opening located near the ejection port and positioned proximally. The trigger housing assembly engagement may be positioned proximally to the trigger opening with the adapter floor wall positioned proximally to the trigger opening wherein the adapter locates an attachable trigger housing assembly from a proximal receiver position to a forward receiver position.

In accordance with another optional aspect, the adapter may further include a mounting hole positioned distal to both the adapter floor wall and trigger opening and positioned proximal to the ejection port.

In accordance with other optional aspects, the trigger housing assembly may include a removable grip wherein the removable grip may be compatible with AR15/M16 firearm types.

In accordance with another optional aspect, the trigger housing assembly engagement of the adapter is at least about two inches from the proximal end of the adapter.

In accordance with yet another optional aspect, the adapter further includes a cheek weld to optionally replace a rear sight of the machine gun.

In accordance with another optional aspect, an extended trigger housing assembly for an M240 machine gun is provided which has a proximal end and a distal end and is connectable to an M240 machine gun receiver. The trigger housing assembly may also have a proximal leg to connect to a trigger housing assembly engagement of the M240 machine gun receiver wherein the extended trigger housing assembly positions the trigger housing assembly to a forward receiver position.

In accordance with another optional aspect, the trigger housing assembly may comprise a removable grip.

In accordance with still another optional aspect, the trigger of the trigger housing assembly is located distally to a mounting hole on the M240 machine gun receiver when attached.

In accordance with another optional aspect, a new M240 machine gun is provided which includes an M240 machine gun having a receiver with a floor, top, proximal end, and distal end; a butt stock connected to a proximal end of the receiver; a barrel connected to a distal end of the receiver; and a trigger housing assembly with a grip, the trigger housing assembly attached to the floor of the receiver and positioned in a forward position with the grip spaced distally from the proximal end of the receiver.

In accordance with another optional aspect, a new M240 machine gun may have a receiver with a floor that includes an ejection port, trigger opening, and receiver floor wall, wherein the trigger opening is positioned between the receiver floor wall and the ejection port.

In accordance with another optional aspect, a new M240 machine gun may include a receiver with a mounting hole positioned distal to both the receiver floor wall and trigger opening and positioned proximal to the ejection port.

In accordance with another optional aspect, a new M240 machine gun may include a trigger housing assembly with a proximal leg for engaging a trigger housing assembly engagement on the receiver with the trigger housing assembly engagement located at about the proximal end of the receiver.

In accordance with another optional aspect, a new M240 machine gun may include an operating rod with a sear engagement located distally from the operating rod's rear body portion.

In accordance with other optional aspects, a new M240 machine gun may include a shortened butt stock. Also, the butt stock may have a top surface that is about even with the top surface of the receiver.

In accordance with another optional aspect, a new M240 machine gun may have a cheek surface on the top of the receiver.

In accordance with other optional aspects, a new M240 machine gun may include a receiver formed from a unitary first shell and a unitary second shell. Furthermore, the union of the unitary first shell and the unitary second shell may form the ejection port and trigger opening with the trigger housing assembly of the new M240 machine gun attached in a forward position.

In accordance with another optional aspect, a new M240 machinegun may position a proximal end of the grip of the trigger housing assembly at least about two inches from proximal end of the receiver.

In accordance with one optional aspect, a handguard for a machine gun has a first side, a second side, a bottom side as well as an exterior surface and an interior surface with the interior surface of the handguard having one or more bosses to engage one or more slots on a receiver of the machine gun.

In accordance with another optional aspect, the handguard may further include an interface system on at least one side for accessory components. The interface system may include a variety of interface systems that may be used for firearms which includes both KeyMod as well as Picatinny rails.

In accordance with other optional aspects, the handguard may include a bipod attachment and in some optional embodiments the bipod attachment may be a pintle mount.

In accordance with another optional aspect, the interior surface of the handguard may include two bosses to engage two slots on the receiver of the machine gun.

In accordance with yet another optional aspect, the handguard may further include one or more attachment points on one or more sides of the handguard to correspond to one or more mounting points on the receiver of the machine gun.

In accordance with another optional aspect, attachment hardware may be included that engages the one or more attachment points on the one or more sides of the handguard and the one or more mounting points on the receiver of the machine gun. Such attachment hardware may include screws, such screws optionally being #10-32 screws.

In accordance with another optional aspect, three or more attachment points on the first side of the handguard may correspond to three or more mounting points on the first side of the receiver and three or more attachment points on the second side of the handguard may correspond to three or more attachment points on the second side of the receiver.

In accordance with another optional aspect, a handguard for an M240LW machine gun is provided with a first side, a second side, and a bottom side, an exterior surface and an interior surface. The interior surface of the handguard having one or more bosses to engage one or more slots on a receiver of the M240LW machine gun; the first side having one or more attachment points to correspond to one or more mounting points on a first side of the receiver of the M240LW machine gun; the second side having one or more attachment points to correspond to one or more mounting points on a second side of the receiver of the M240LW machine gun; and one or more of the sides having an interface system for accessory components.

In accordance with yet another optional aspect, the handguard may include one or more bosses on the interior surface of the first side of the handguard and one or more bosses on the interior surface of the second side of the handguard.

In accordance with still another optional aspect, each side of the handguard may include an interface system for accessory components.

In accordance with another optional aspect, a method of installing a handguard on a machine gun is provided which includes the steps of having a machine gun with a receiver; providing a handguard comprising a first side, a second side and a bottom side, an exterior surface and an interior surface, the interior surface of the handguard having one or more bosses to engage one or more slots on a receiver of the machine gun, and the one or more sides including attachment points to correspond to mounting points on the receiver; fitting the handguard onto the receiver of the machine gun with the bosses of the interior surface of the handguard engaging the slots on the receiver of the machine gun; aligning the attachment points of the handguard with the mounting points of the receiver of the machine gun; and engaging aligned attachment points and mounting points with attachment hardware.

In accordance with yet another optional aspect, the steps of installing a handguard on a machine gun may further include three aligned attachment points and mounting points engaged with attachment hardware on the first side of the handguard and three aligned attachment points and mounting points engaged with attachment hardware on the second side of the handguard. The attachment hardware may comprise screws which may be #10-32 screws.

In still another optional aspect, a bipod assembly for mounting to a handguard may include a main bipod body; a first leg and a second leg attached to the main bipod body, each leg being rotatably attached; a pintle on the main bipod body for attaching to a pintle mount of the handguard; and one or more bosses adjacent to the pintle for limiting rotational travel of the bipod assembly when it is engaged to the handguard.

In accordance with other optional aspects, the bipod assembly may include two bosses adjacent to the pintle on the main bipod body.

In accordance with another optional aspect, the bipod assembly may be removably attachable to the handguard.

Further optional aspects include an adapter for an M240 machine gun for connecting to a receiver of an M240 machine gun. The adapter may have an ejection port located at about the distal end of the adapter and a trigger opening near the ejection port and positioned proximally. In such optional aspects, the adapter moves an attached trigger assembly distally forward compared to a conventional M240 machine gun.

Another optional aspect includes a top cover assembly for an M240 machine gun with a proximal end and a distal end; an integrated sight mount at about the proximal end of the top cover assembly; a receiver connection point at about the distal end of the top cover assembly, the receiver connection point operable with a detent assembly; and an attachment interface for mounting accessories.

In accordance with another optional aspect, the top cover assembly further includes an attachment interface spanning from the receiver connection point to the integrated sight mount.

Still another optional aspect includes a top cover assembly wherein the receiver connection point comprises a detent operable to selectively maintain the top cover assembly in an open position on an M240 machine gun. This may optionally include a detent pin on a receiver of the M240 machine gun.

In another optional aspect, the top cover assembly includes a rivetless top cover assembly. Additionally, the top cover may optionally include flat surfaces adjacent to the attachment interface. Furthermore, the attachment interface may span to the receiver connection point with the attachment interface operable to mount a scope.

In another optional aspect, an M240 machine gun barrel assembly includes a barrel with a distal end and a proximal end and a bore; the barrel having a barrel axis spanning through the distal end and proximal end of the barrel and parallel with the bore; a handle assembly with a handle and a handle connector, the handle connector for connecting the handle assembly to the barrel; the handle having a free end and a connected end, the connected end operably connected to the handle connector and the free end not connected to the handle connector; the handle having a linear axis beginning at the connected end and spanning through the handle and out a center of the free end of the handle; and the handle operable between a first position with the free end of the handle pointing proximally and a second position with the free end of the handle assembly pointing distally.

In yet another optional aspect, the handle of the handle assembly points proximally with the linear axis of the handle oriented about parallel to the barrel axis. In another aspect, the free end of the handle points distally with the linear axis of the handle oriented about parallel to the barrel axis. In yet a further optional aspect, the free end of the handle assembly points distally with the linear axis of the handle oriented away from the barrel axis. In other aspects, the free end of the handle assembly points distally with the linear axis of the handle oriented to intersect the barrel axis.

A further optional aspect includes an M240 machine gun barrel assembly with a release button to operably select between the first position and the second position of the handle. The handle may also include a first notch to engage the release button to orient the handle in a first position with the free end of the handle pointing proximally and a second notch to engage the release button to orient the handle in a second position with the free end of the handle pointing distally.

A further optional aspect includes an M240 machine gun barrel assembly with a barrel with a muzzle end at the distal end of the barrel and a breach end at the proximal end of the barrel; a removable gas block with a front sight attached to the gas block; and a gas block retainer for retaining the gas block on the barrel of the barrel assembly. Optionally, the gas block retainer may further include internal threads to correspond to external barrel threads to retain the gas block.

Another optional aspect of the removable gas block includes the front sight being adjustable between a folded position and an erect position. The front sight may optionally be adjustable for elevation and windage.

Yet another optional aspect includes an M240 machine gun with a locking lever; the locking lever operable to engage a bolt assembly at the locking lever's distal end and the locking lever operable to engaged an operating rod assembly at about the locking lever's proximal end; and the locking lever having two contact surfaces for engaging a receiver guide; each contact surfaces having a flat surface transitioning to a curved surface with only one apex. Another optional aspect includes a locking lever wherein each apex of each contact surface is located on each curved portion about beneath the terminal proximal end of each contact surface when the locking lever is laid flat.

As used herein, the term "engage" means to interact with, interlock with, associate with or communicate with.

The term "providing," and forms thereof, are used in a broad sense, and are referred to, but are not limited to making available for use, enabling usage, giving, supplying, obtaining, getting hold of, acquiring, making ready for use, and/or placing into position ready for use.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of the specification. The drawings illustrate optional embodiments of the invention and together with the description serve to explain some principles of the invention.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawings and in the description referring to the same or like parts.

DETAILED DESCRIPTION

Figure 1:
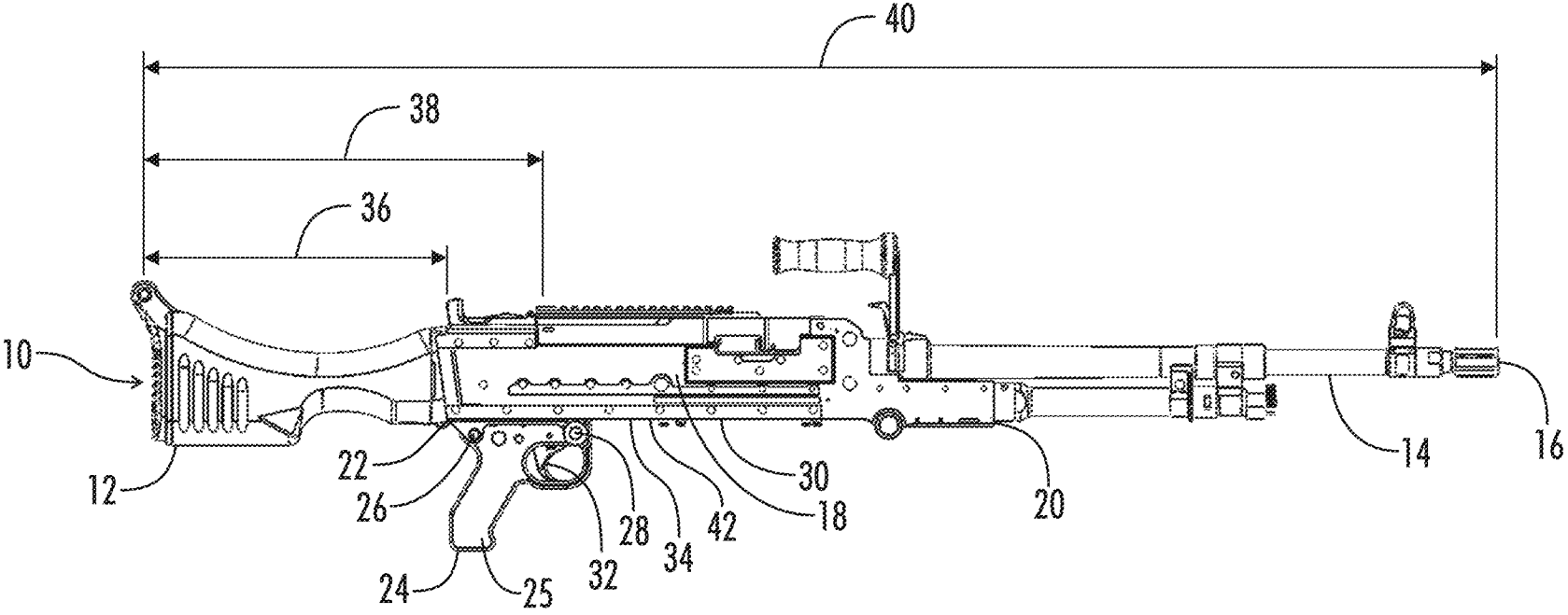
FIG. 1 (PRIOR ART)
FIG. 1 is an illustration of a prior art M240 machine gun.

While the making and using of various embodiments are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Where the various figures may describe embodiments sharing various common elements and features with other embodiments, similar elements and features are given the same reference numerals and redundant description thereof may be omitted below. Generally, different, but similar reference numbers (e.g. 42 and 142) will be used to show that some parts are replaced. Numerals that indicate proximal and distal will generally stay the same even though they might be for different locations on different elements.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." Furthermore, to the extent the term "connect" is used in the specification or claims, it is intended to mean not only "directly connected to," but also "indirectly connected to" such as connected through another component or multiple components.

To facilitate the understanding of the embodiments described herein, a number of terms are defined below. The terms defined herein have meanings as commonly understood by a person of ordinary skill in the areas relevant to the embodiments described herein. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Referring to FIG. 1, there is an illustration of a prior art M240 machine gun designated by numeral 10. Generally, such firearm is manufactured by Fabrique Nationale. The M240 machine gun 10 includes butt stock 12, barrel 14, muzzle 16 and receiver 18. Generally, distal end of receiver 18 is designated by numeral 20 and proximal end of receiver 18 is designated by numeral 22. Trigger housing assembly 24 includes grip 25 and trigger 32. Receiver 18 of machine gun 10 includes receiver floor 42. Alternatively, the term "bottom" may be used interchangeably with "floor" and mean the same. Receiver floor 42 of receiver 18 includes trigger assembly engagement 26 and mounting point 28. Generally, the prior art M240 machine gun 10 is understood to have a conventional box-like receiver assembled from separate parts, with overlapping plate edges that are riveted together.

Receiver floor 42 further includes ejection port 30 for fired brass to be expended from the firearm. Generally, the M240 machine gun 10 has a butt stock length designated by numeral 36. Butt stock length 36 is a length of distance from the proximal end of the butt stock to the distal end of the butt stock where it connects to the proximal end of receiver 18. The length of pull of the M240 machine gun 10 is designated by numeral 38 and is generally understood to be the distance from trigger 32 to the proximal end of butt stock 12. The overall length of the firearm is indicated by numeral 40.

Figure 2:
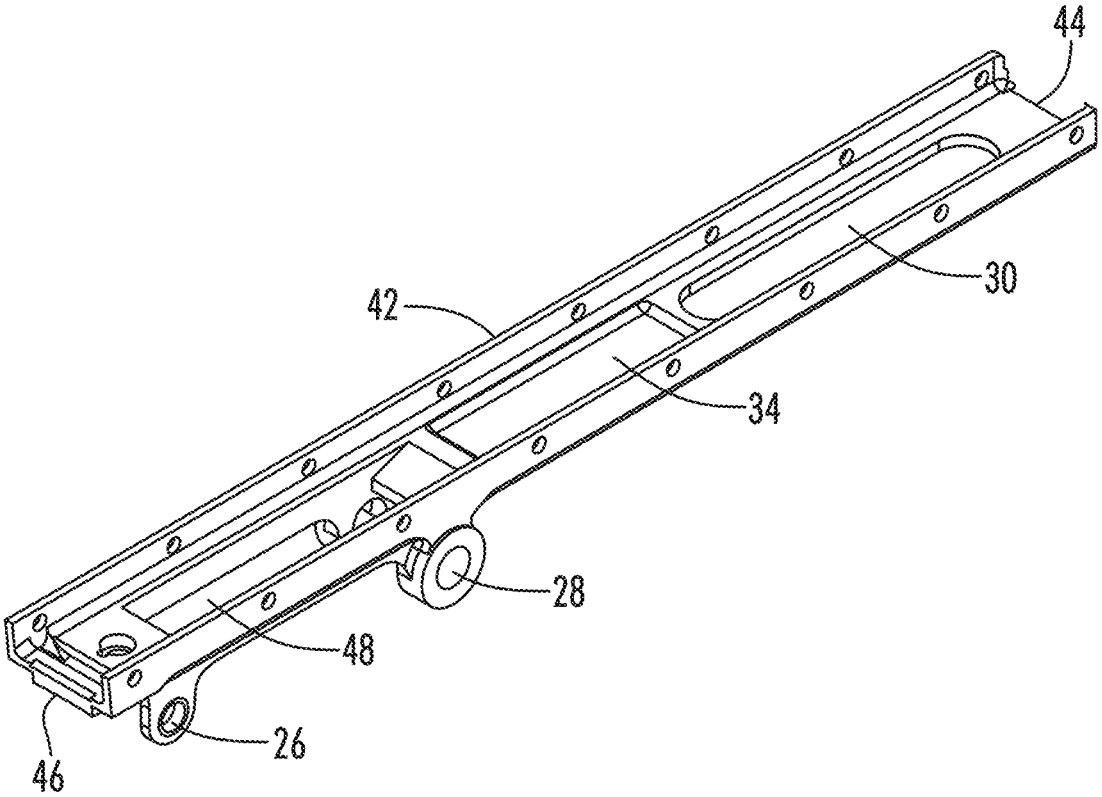
FIG. 2 (PRIOR ART)
FIG. 2 is an illustration of a prior art bottom portion of a receiver of an M240 machine gun.

Referring now to FIG. 2, there is an illustration of an M240 machine gun's receiver floor, previously designated by numeral 42. This is generally riveted to receiver 18 of the FN variety prior art M240 machine gun designated by numeral 10 and illustrated in FIG. 1. Receiver floor 42 includes distal end 44 and proximal end 46. As previously described, receiver floor 42 also includes first trigger assembly engagement 26 and mount point 28. Between first trigger assembly engagement 26 and mount point 28, trigger opening 48 is positioned so that trigger 32 of trigger housing assembly 24 may pass there between in connecting with the fire control components within the receiver (not shown). Between trigger opening 48 and ejection port 30, there is receiver floor wall 34. In embodiments of the prior art FN M240 machine gun as illustrated in FIG. 1, receiver floor 42 positions the trigger housing assembly 24 so that the end of grip 25 is about even with proximal end 22 of receiver 18. Generally, trigger opening 48 is located toward the proximal end of receiver floor 42 and ejection port 30 is located toward the distal end of receiver floor 42 with receiver floor wall 34 positioned there between.

Figure 3:
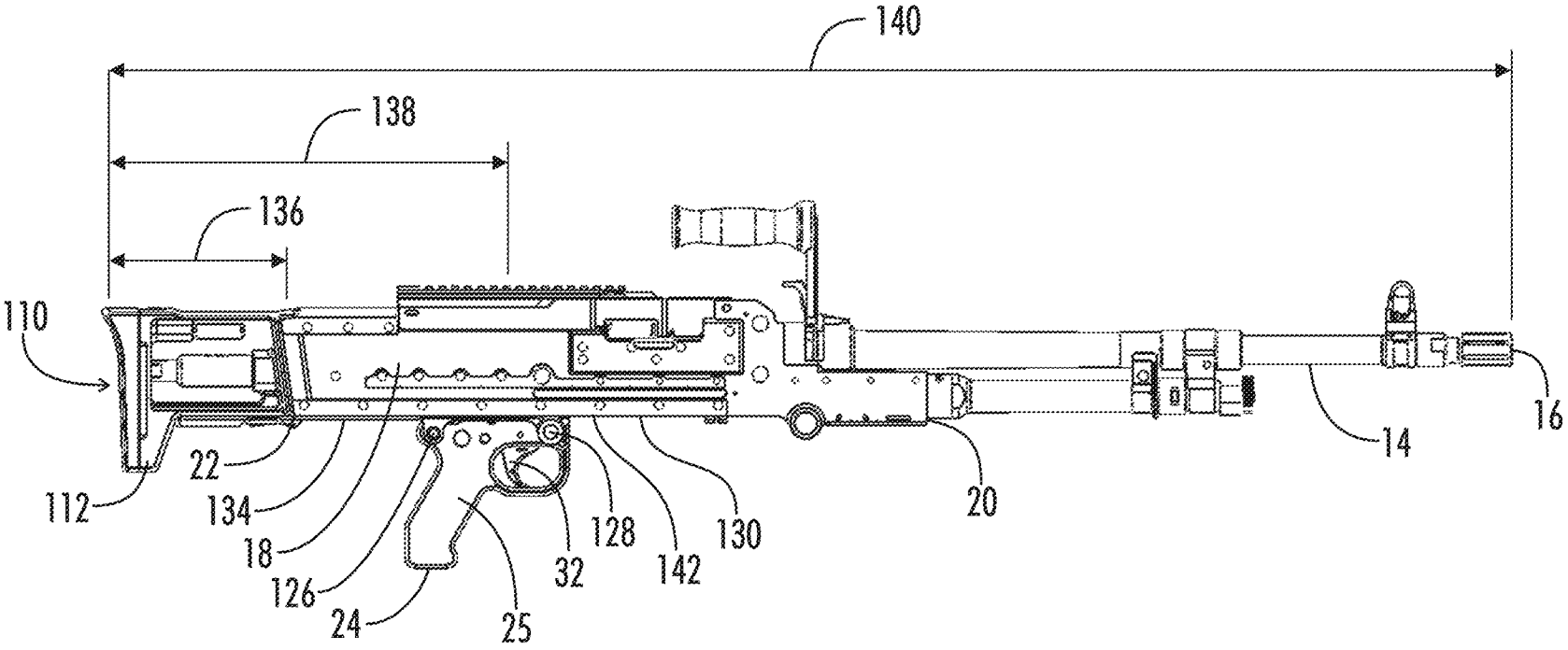
FIG. 3 is an illustration of an optional embodiment of an M240 machine gun with adapter to move a trigger housing assembly distally forward.

Referring to FIG. 3, there is an optional embodiment of applicant's invention designated by numeral 110. More specifically, FIG. 3 illustrates an M240 machine gun having adapter 142 in place of receiver floor 42. M240 machine gun 110 includes butt stock 112, barrel 14, muzzle 16 and receiver 18 (since the receiver includes many of the same features as in FIG. 1, absent the receiver floor, the receiver in FIG. 3 is still indicated by then numeral 18). Receiver 18 includes distal end 20 and proximal end 22. In having bottom adapter 142, new M240 machine gun 110 with receiver 18 includes adapter 142 with receiver floor wall 134 between the proximal end 22 of receiver 18 and trigger housing assembly engagement 126. Furthermore, adapter 142 includes trigger housing assembly engagement 126 so that trigger housing assembly 24 can be attached to new M240 machine gun 110 via the engagement in conjunction with trigger opening 148. Trigger assembly 24 further includes grip 25 and trigger 32. In front of trigger assembly 24 is ejection port 130. Otherwise stated, ejection port 130, through which spent brass is sent, is located between distal end 20 and trigger housing assembly 24 of receiver 18. The use of adapter 142 does not require the relocation of the ejection port. Furthermore, the mounting point is indicated by numeral 128.

Advantageously, trigger housing assembly 24 is moved distally forward when compared to the prior art M240 machine gun as appears in FIG. 1. In some optional embodiments, trigger housing assembly is moved inches forward, some optional embodiments have the trigger housing assembly moved greater than two inches distally. In some further optional embodiments, the trigger housing assembly may be moved greater than three inches distally. In yet more optional embodiments, the trigger housing assembly may be moved about 3.3 inches distally. Otherwise stated, trigger housing assembly 24 can be considered to be roughly in about the middle of adapter 142. Further advantageous is that a conventional trigger housing assembly can be utilized in this new location. In some optional embodiments, the overall length 140 of the new M240 machine gun designated by numeral 110 may be shorter than the overall length 40 of the traditional M240 machine gun designated by numeral 10 and illustrated in FIG. 1.

By having trigger assembly 24 moved forward, butt stock length 136 of butt stock 112 may be shorter than butt stock length 36 of butt stock 12 of the prior art M240 machine gun 10 while achieving a sufficient length of pull. This is illustrated by comparing butt stock length 36 of FIG. 1 to that of butt stock length 136 of FIG. 3. However, length of pull 138 of the new M240 machine gun of FIG. 3 may be substantially similar to that of length of pull 38 of the prior art M240 machine gun of FIG. 1 as trigger assembly 24 of M240 machine gun 110 has moved forward with the firearm having a shorter butt stock 112. The overall length 140 of the M240 machine gun as embodied in FIG. 3 may also be shorter than that of overall length 40 of FIG. 1.

Additionally, the M240 machine gun as designated by numeral 110 in FIG. 3 may have an improved balance as trigger assembly 24 with grip 25 is moved forward thus helping further distribute the weight of the firearm. Optionally, in further optional embodiments, butt stock 112 may be of an adjustable design so that a customizable length of pull may be realized. In some optional embodiments, buttstock 112 may include an internal piston or hydraulic design that assists in the function of M240 machine gun 110.

Figure 4:
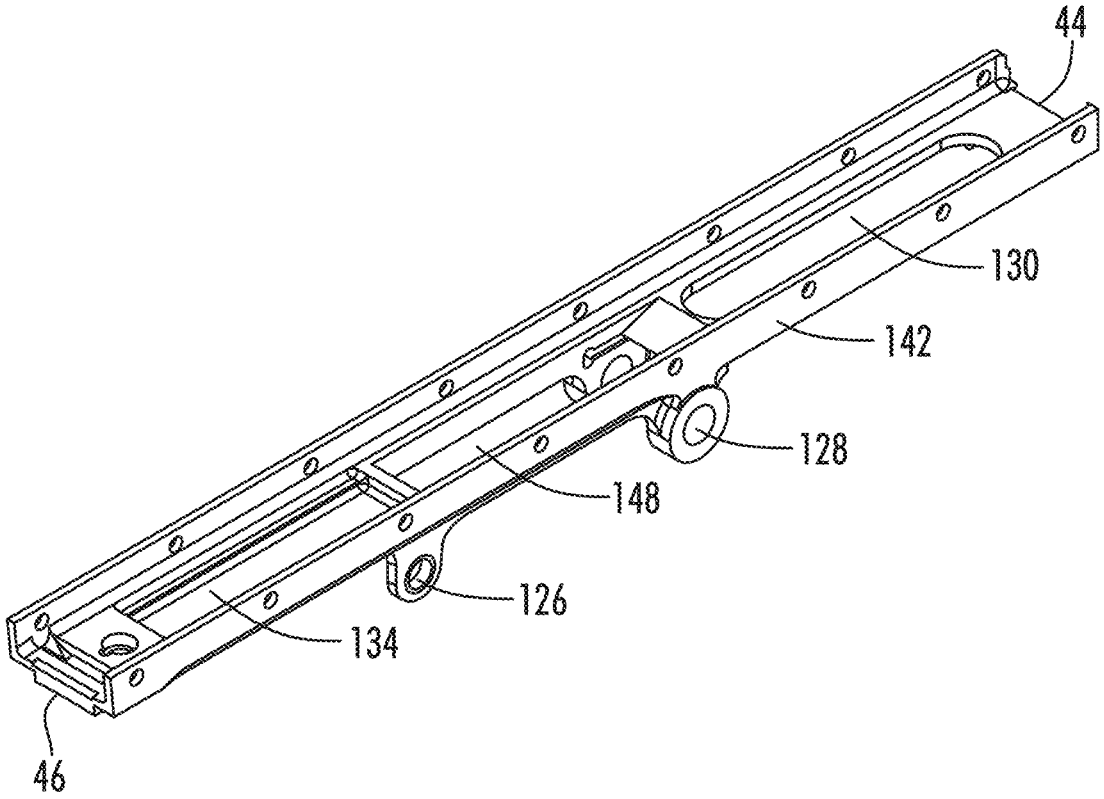
FIG. 4 is an illustration of an optional embodiment of the adapter for an M240 machine gun.

Referring now to FIG. 4 there is an illustration of adapter 142 which is utilized to move trigger assembly 24 forward as seen in FIG. 3. Generally, adapter 142 is understood to replace receiver floor plate 42 of a traditional M240 machine gun. Most conventional M240 machine guns have a riveted box receiver design and thus the existing receiver floor plate 42 can be removed and adapter 142 riveted in place instead. In other optional embodiments, adapter 142 may be attached in different manners to the receiver.

Generally, adapter 142 includes distal end 44 and proximal end 46. Adapter floor wall 134 is proximally located to trigger opening 148 and thus also adjacent to about proximal end 46 of adapter 142. Trigger opening 148 is understood as being between adapter floor wall 134 and ejection port 130 of adapter 142. As previously mentioned, bottom plate adapter 142 can also include trigger assembly engagement 126 and mounting point 128. Trigger opening 148 is thus positioned between trigger assembly engagement 126 and mounting point 128 if included, with ejection port 130 distal to trigger opening 148.

In yet further optional embodiments, the adapter may be formed of a variety of different metals including various forms of steel and the like. In yet further optional embodiments it is possible that adapter 142 could be formed of various other alloys and metals including aluminum and further could also possibly be formed of different composite materials. Further possibilities include the formation of adapter from plastic materials.

Figure 5:
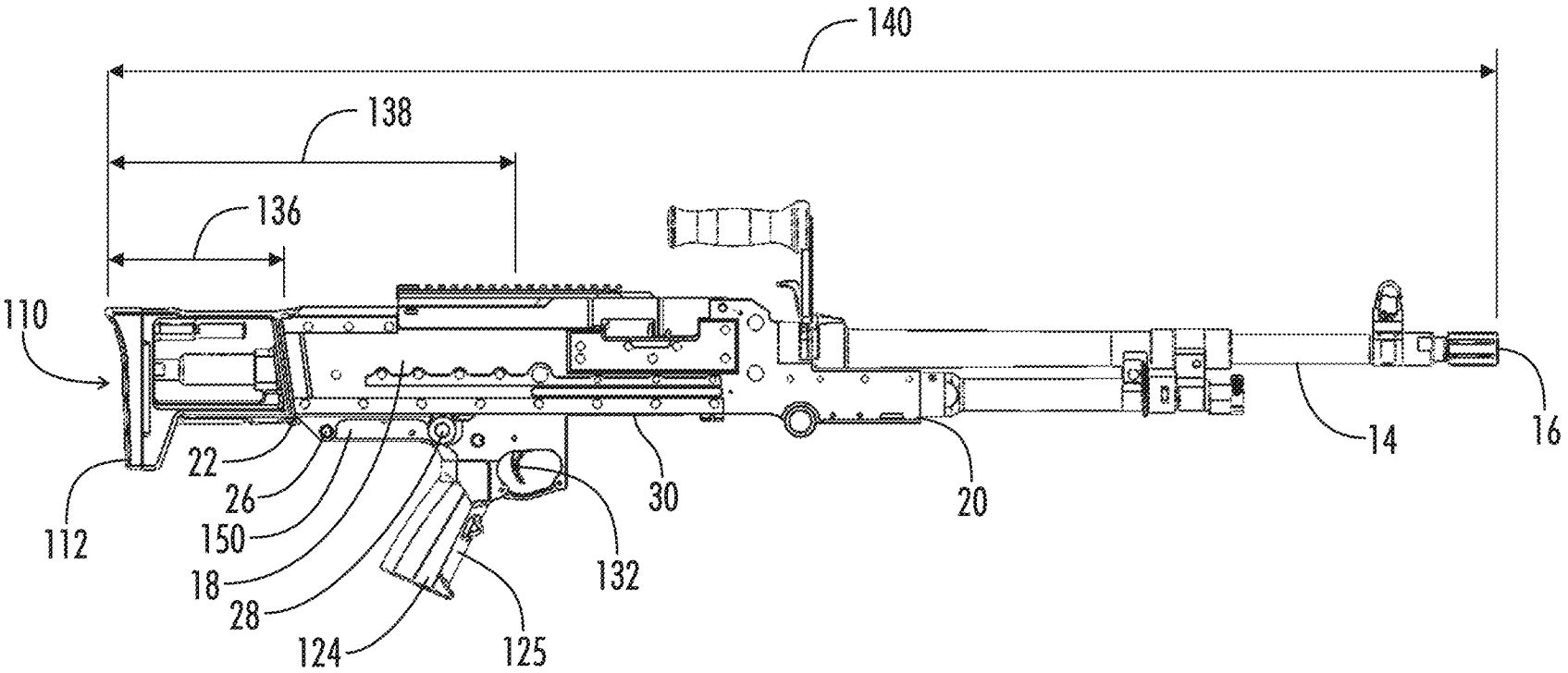
FIG. 5 is an illustration of an optional embodiment of an M240 machine gun having a trigger assembly with proximal leg.

Referring now to FIG. 5, there is an additional optional embodiment of M240 machine gun 110. In comparing and contrasting the new M240 machine gun 110 of FIG. 5 with the FN M240 machine gun as illustrated in FIG. 1, the butt stocks and trigger housing assemblies are different (as well as some internals). Here, as detailed in the illustration of FIG. 5, trigger 132 is also moved distally, similarly to the M240 machine gun as illustrated in FIG. 3, however, adapter 142 is not utilized. Rather, extended trigger housing assembly 124 is used to facilitate the distal relocation of trigger 132. Notably, in such embodiments, the receiver floor plate 42 may remain as it is in FIG. 1 (as well as receiver 18), as extended trigger housing 124 may fit to the original receiver floor of an M240 machine gun.

Extended trigger housing assembly 142 includes proximal leg 150. With proximal leg 150 of extended trigger housing assembly 142, extended trigger housing assembly 124 can engage trigger housing assembly engagement 26 to be secured to receiver 18 of new M240 machine gun 110. Proximal leg 150 provides the necessary length and linkage so that grip 125 and trigger 132 can be moved distally forward so that butt stock 112 has a shorter butt stock length 136. Thus, overall length 140 of M240 machine gun 110 as depicted in FIG. 5 may be shorter than the prior art as depicted in FIG. 1. Advantageously, length of pull 138 may be generally maintained due to extended trigger housing assembly 124 positioning grip 125 and trigger 132 distally forward. In optional embodiments, trigger 132 connects to fire components of the M-240 machine gun through a linkage or the like so that the original opening for the trigger for the machine gun could be used. However, in further optional embodiments, a new trigger opening may be formed in the existing receiver so that the trigger assembly could engage with the fire components in that manner. Furthermore, such extended trigger housing assemblies 142 may facilitate a removable grip 125 that may also be compatible with AR15/M16 style grips.

Figure 6:
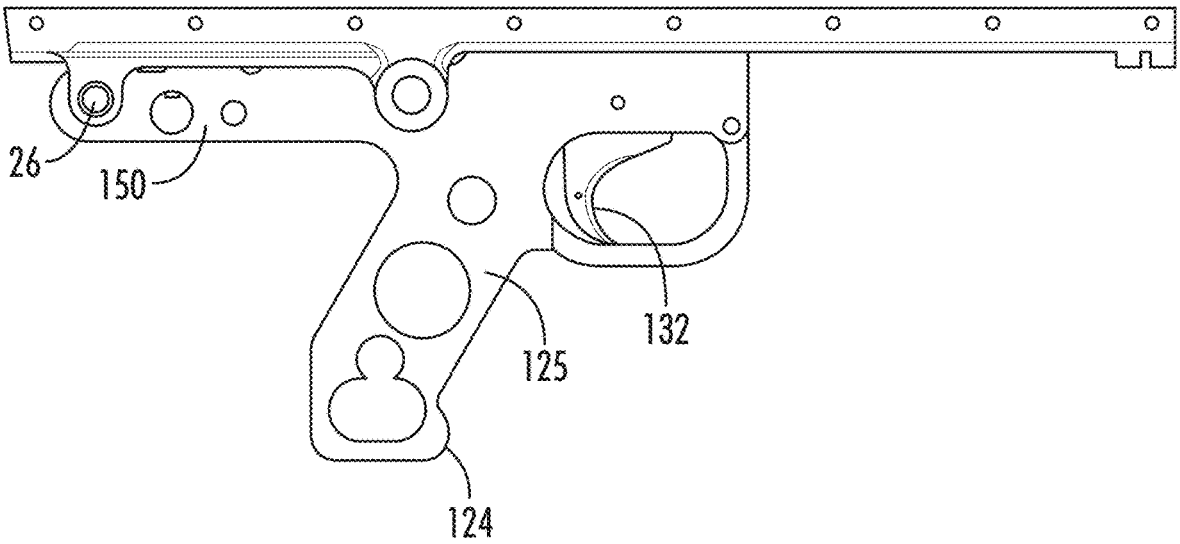
FIG. 6 is an illustration of an optional embodiment of a trigger assembly with proximal leg for an M240 machine gun.

In yet further optional embodiments, another slightly different extended trigger housing assembly 124 is illustrated in FIG. 6 which may be formed of a variety of materials including a variety of metals, alloys and the like as well as composites and/or plastics. In optional embodiments, extended trigger housing assembly 124 with proximal leg 150 may be generally formed or milled of one entire piece of material. In yet further optional embodiments, extended trigger housing assembly 124 may be extruded, milled, cast or formed in a variety of other different manners. Additionally, extended trigger housing assembly 124 may be of a unitary piece or alternatively may be formed of a variety of different pieces combined together. As previously discussed, extended trigger housing 124 may include grip 125, trigger 132, with proximal leg 150 engaging trigger housing assembly engagement 26.

Figure 7:
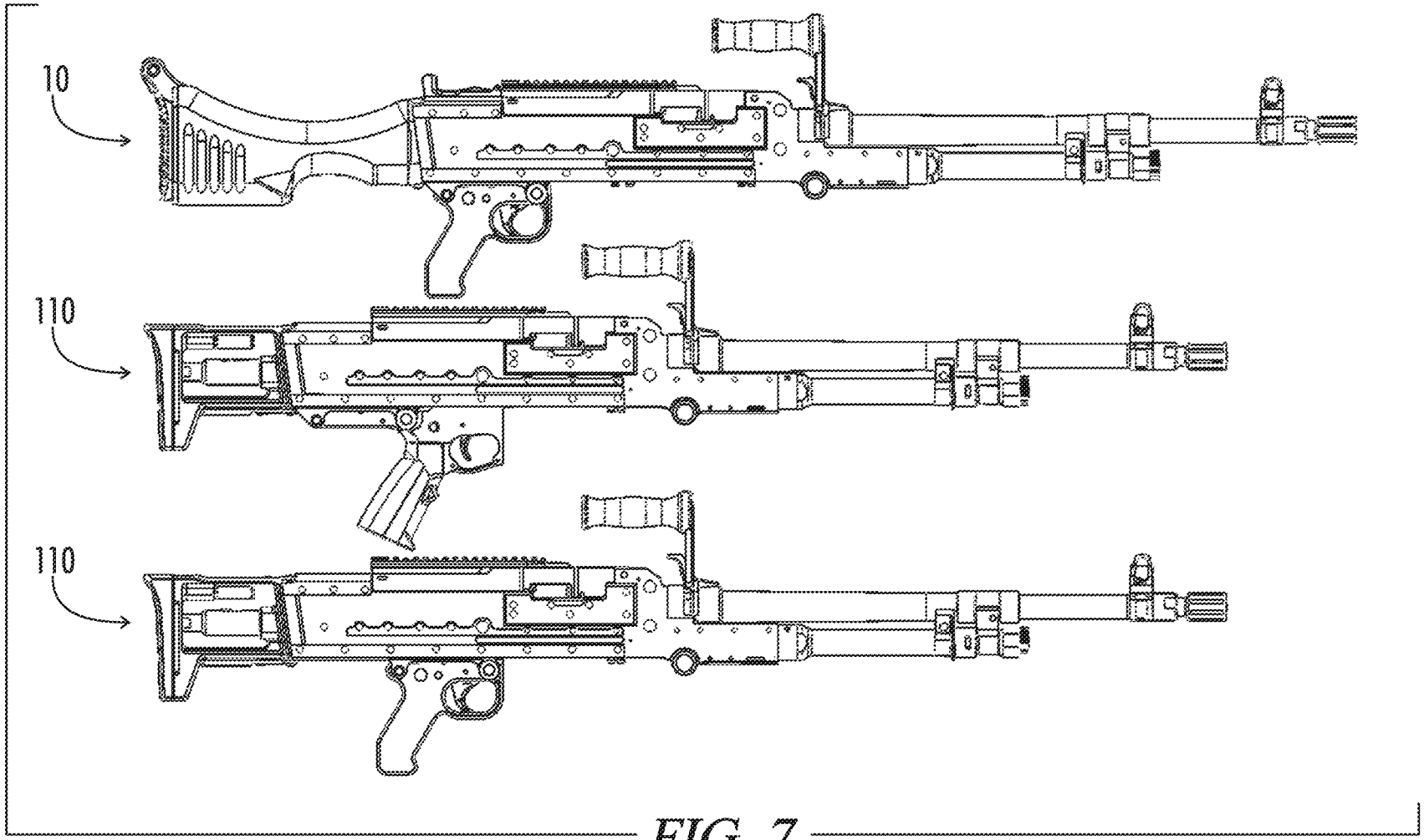
FIG. 7 is an illustration comparing the M240 machine gun of FIG. 1 to the M240 machine gun of FIG. 5 to the M240 machine gun of FIG. 3.

Referring now to FIG. 7, there is a comparison of the original prior art FN M240 machine gun as designated by numeral 10 with the two previously described embodiments of the new M240 machine gun designated by numeral 110. This comparison illustration shows the shorter overall length using either the adapter or extended trigger assembly housing which further advantageously provides greater balance to the firearm.

Figure 8:
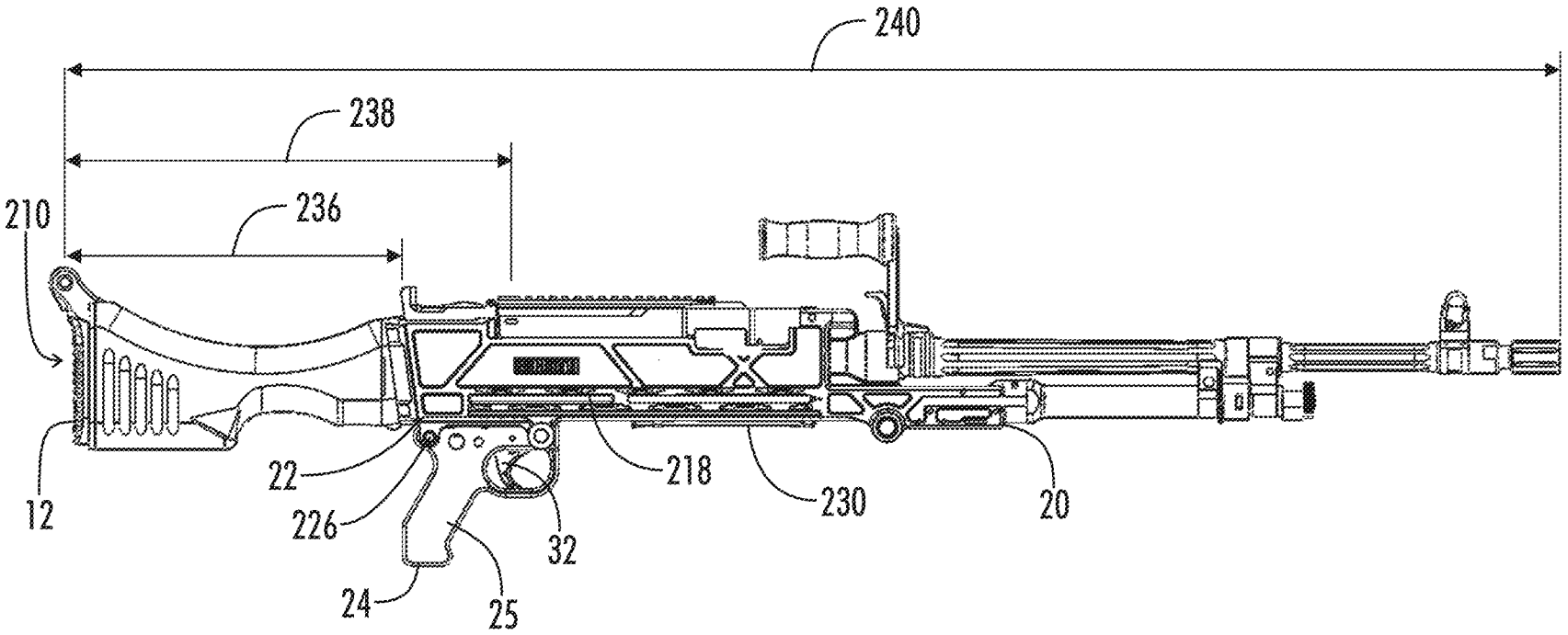
FIG. 8 (PRIOR ART)
FIG. 8 is an illustration of a prior art M240LW machine gun.

Referring now to FIG. 8, there is an illustration of a M240LW machine gun as designed by Barrett Firearms Manufacturing. Generally the M240LW is a M240 variant which uses a unitary first shell and a unitary second shell to create the receiver for the firearm. Such firearm is described in U.S. Pat. No. 7,937,877, issued to Christopher Gene Barrett and entitled "Light Weight Firearm and Method of Manufacturing." U.S. Pat. No. 7,937,877 is incorporated by reference in its entirety with respect to FIGS. 8-11 to the extent that language from the reference does not conflict with the present disclosure. Generally, the M240LW is designated by numeral 210 and can incorporate conventional trigger housing assembly 24 having grip 25 and trigger 32, the trigger housing assembly attaching to receiver 218 via trigger assembly engagement 226. The ejection port is indicated by numeral 230. Generally, conventional butt stock 12 can also be used with the M240LW. Such M240LW machine gun also has butt stock length 236, length of pull 238 and overall length 240. As with the other embodiments, the proximal end is indicated by numeral 22 and the distal end is indicated by numeral 20.

Figure 9:
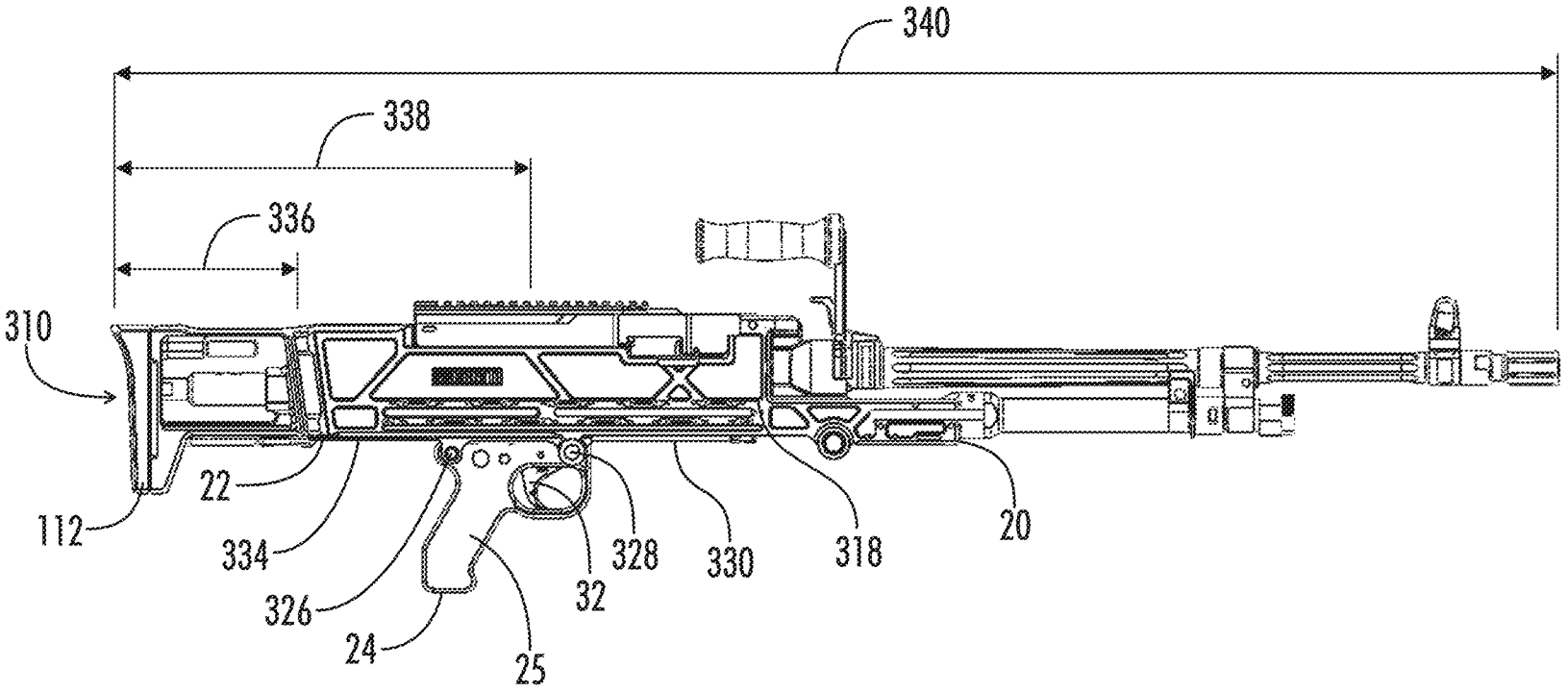
FIG. 9 is an illustration of an M240LW machine gun with the trigger housing assembly located distally forward.

Referring now to FIG. 9, there is a new embodiment which incorporates trigger housing assembly 24, with grip 25 and trigger 32, in a forward position. However, rather than using adapter 142 and incorporating it into an existing receiver as done with the embodiment in FIG. 2, the new machine gun designated by the numeral 310 may include the necessary arrangement for the forward position of trigger housing assembly 24 as part of the shells that form receiver 318. Generally, the trigger housing assembly engagement 326 of receiver 318 is positioned more distally than that of receiver 218. The trigger opening (not shown) may be located between trigger housing assembly engagement 326 and mounting point 328, with receiver floor wall 334 proximal to trigger housing assembly engagement 326. Otherwise stated, in order from proximal end 22 of receiver 318 are receiver floor wall 334, trigger housing assembly engagement 326, trigger opening (not visible), and ejection port 330, then the distal end 20. Optionally butt stock 112 may be used with such an embodiment of the machine gun.

Generally, the benefits of machine gun 310 of FIG. 9 are similar to those as previously described for M240 machine gun 110 of FIG. 2, but with additional improvements. As the M240LW machine gun variant is already lighter than the traditional M240 machine gun, the additional decrease in length of machine gun 310 with a clamshell design provides for even greater maneuverability than the M240 machine gun 110 of FIG. 2.

Figure 10:
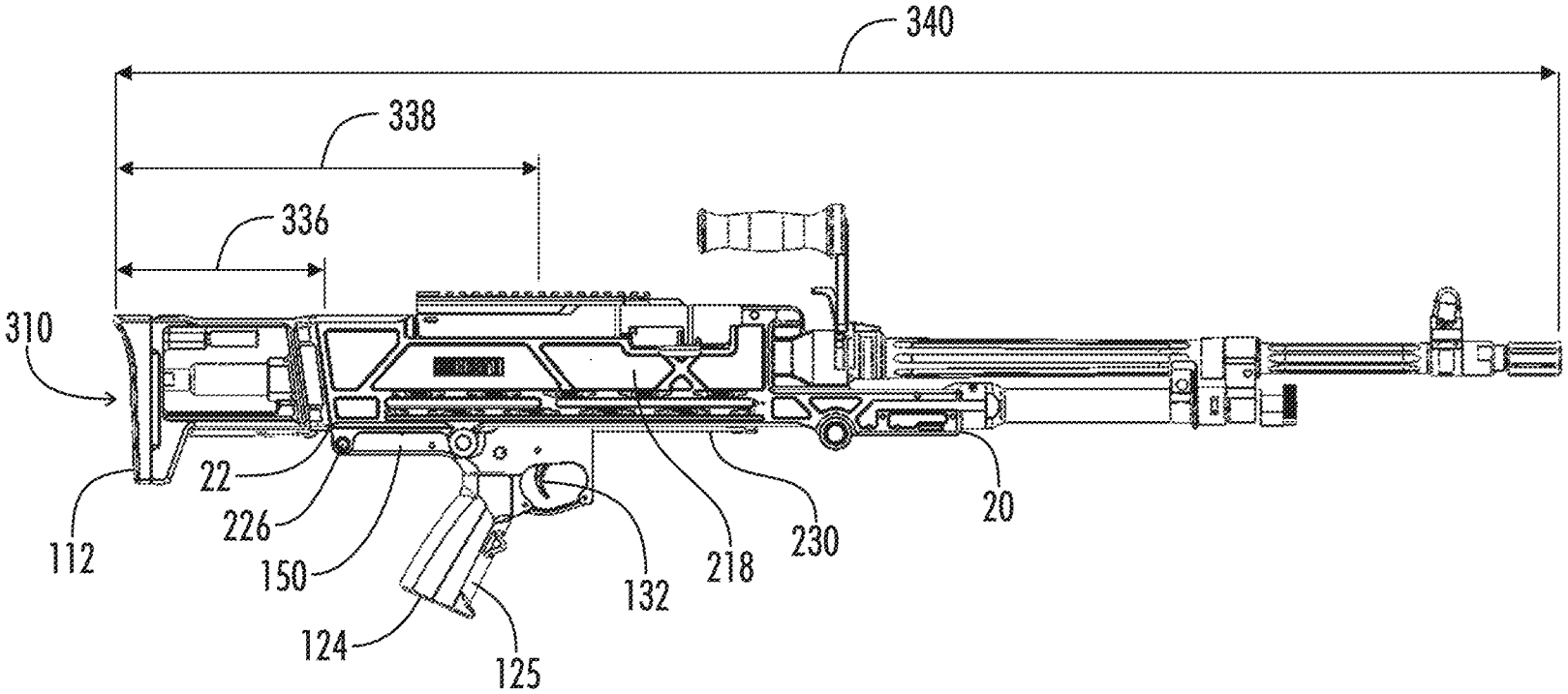
FIG. 10 is an illustration of an M240LW machine gun with a trigger housing assembly with proximal leg.

Referring now to FIG. 10, there is an embodiment of variant of the M240LW machine gun 310 with extended trigger assembly 124. In this optional embodiment of machine gun 310, the receiver is identified by numeral 218 and is generally the same as that of M240LW machine gun 210 as provided in FIG. 8. Here, extended trigger housing assembly 124 includes proximal leg 150 and attaches to trigger housing engagement 226 via the proximal leg 150. Furthermore, as provided previously, trigger housing assembly 124 includes grip 125 and trigger 132. Similar to the M240LW as indicated in FIG. 8, the receiver is about the same as indicated by numeral 218. In further optional embodiments, grip 125 may be removable from trigger housing assembly 124. In some other optional embodiments, trigger housing assembly 124 may be compatible with grips that will fit a standard AR15/M16 type firearm. Ultimately, grip 125 and trigger 132 are positioned distally forward toward distal end 20 and away from proximal end 22 as occurred with conventional M240 machine guns.

Figure 11:
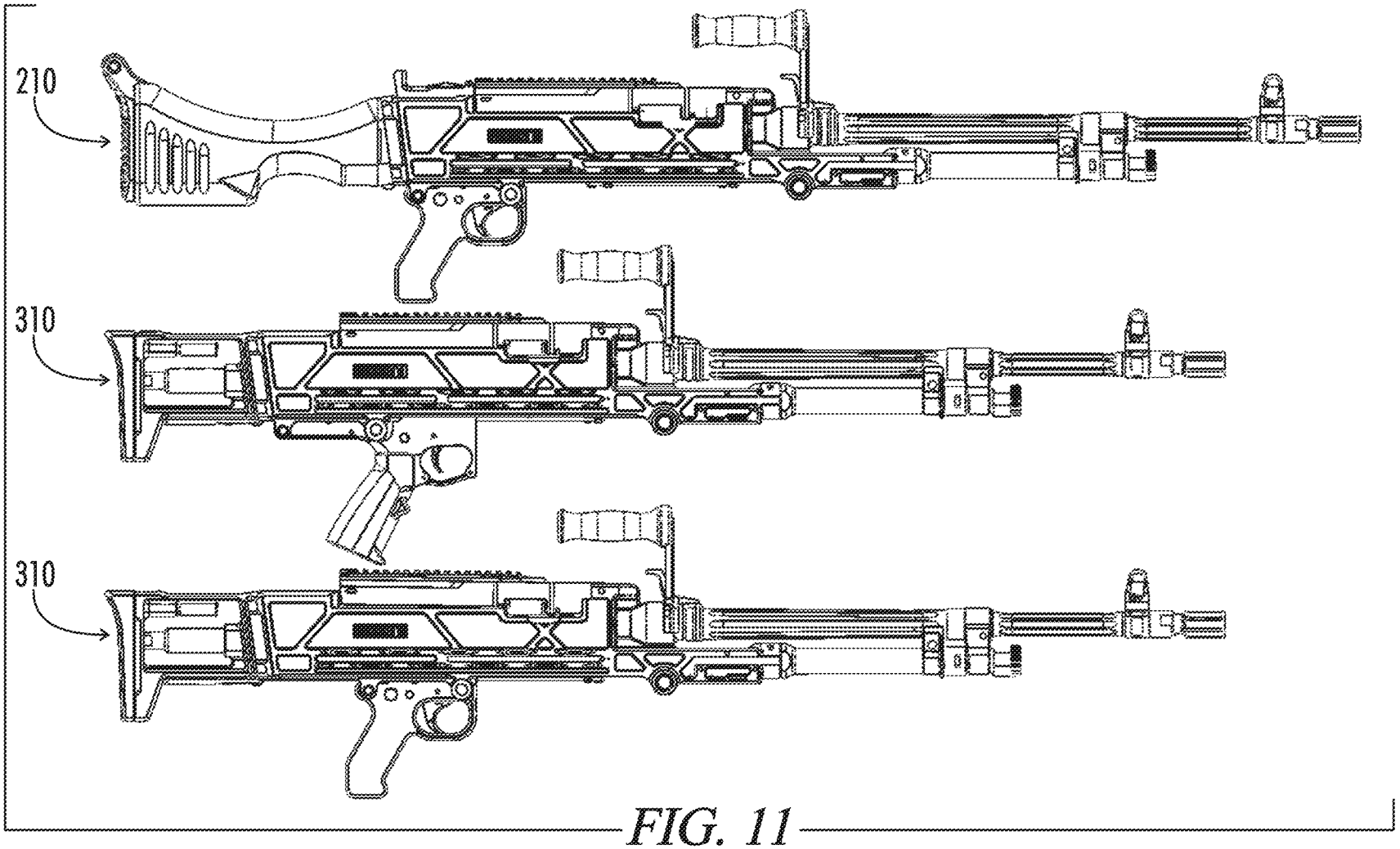
FIG. 11 is an illustration comparing the M240LW machine gun of FIG. 8 to the M240LW machine gun of FIG. 10 to the M240 machine gun of FIG. 9.

Referring now to FIG. 11, there is a comparison of the original Barrett M240LW machine gun as designated by numeral 210 with the two previously described embodiments of the new machine guns designated by numeral 310. This comparison illustration shows the shorter overall length using either the adapter or extended trigger assembly housing which further advantageously provides greater balance to the firearm.

Figure 12A:
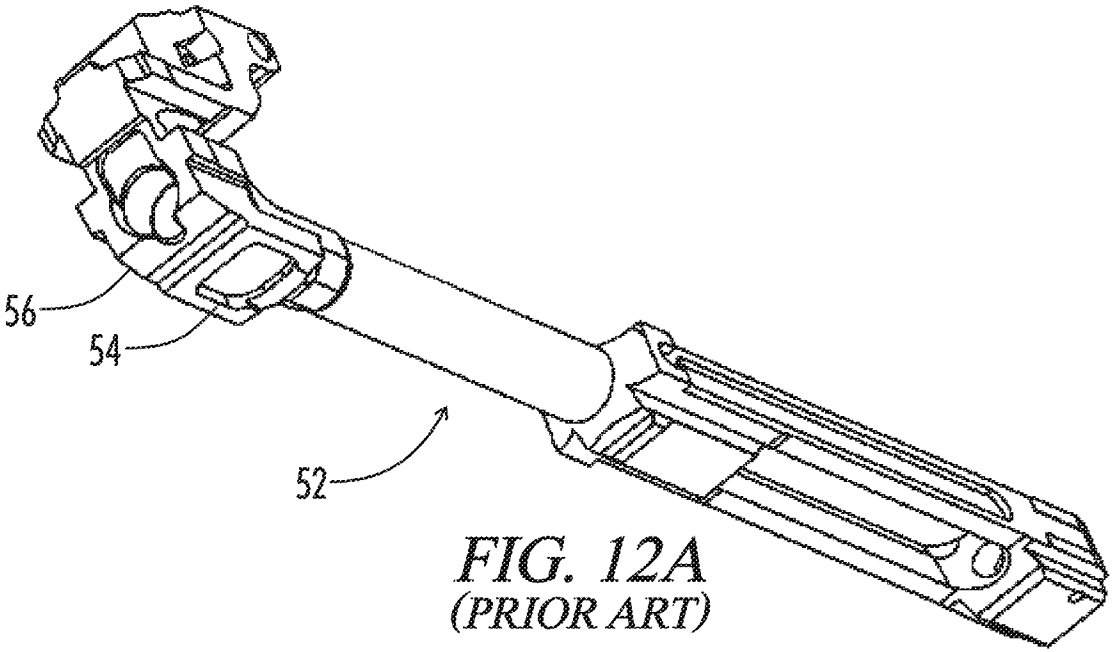
FIG. 12A (PRIOR ART)
FIGS. 12*a* and 12*b* are illustrations of an operating rod assembly for an M240 machine gun.
Figure 12B:
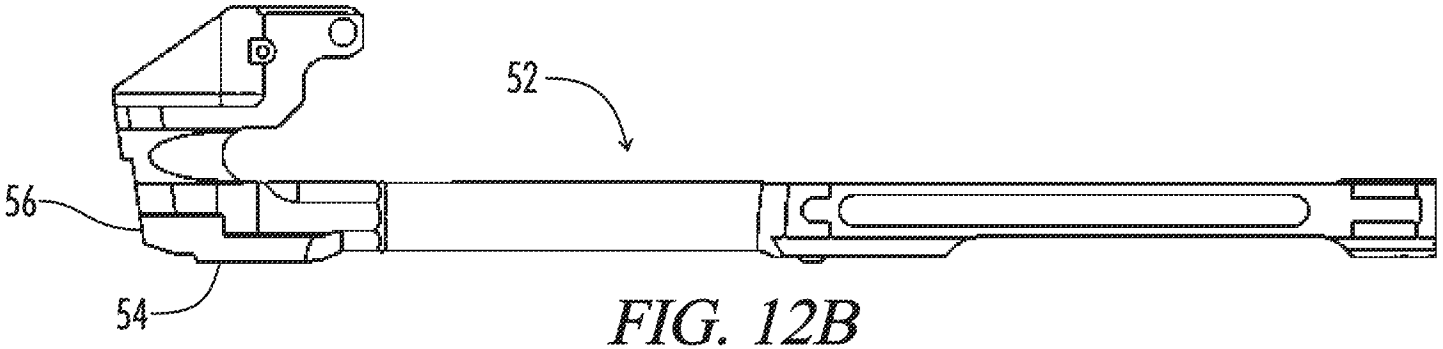
FIG. 12B (PRIOR ART)

Referring now to FIGS. 12*a* and 12*b*, there is an embodiment of an operating rod assembly for a M240 machine gun as illustrated in FIG. 1, the operating rod assembly designated by numeral 52. Generally, operating rod assembly 52 includes sear engagement 54 on the underside of rear section 56 of operating rod assembly 52. As trigger housing assembly 24 is located near the proximal end of receiver 18 of the conventional M240 machine gun, trigger housing assembly 24 is appropriately positioned so as to properly position the sear (not shown) to communicate with sear engagement 54 on the underside of rear section 56 of operating rod assembly 52.

Figure 13A:
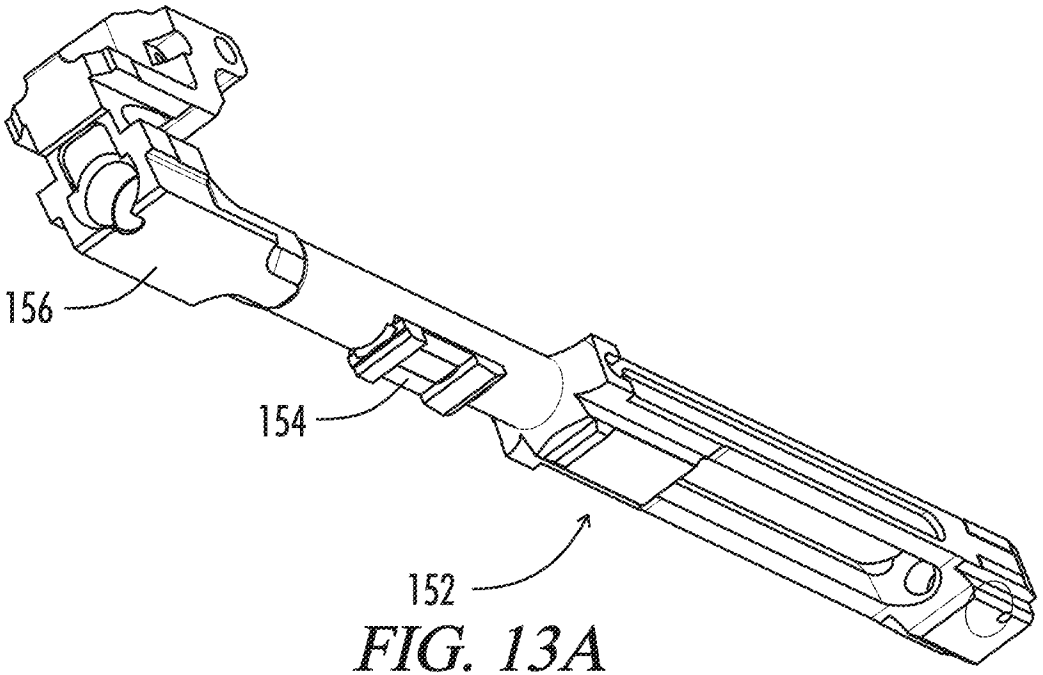
FIGS. 13*a* and 13*b* are illustrations of an operating rod assembly with the sear engagement located distally forward.
Figure 13B:
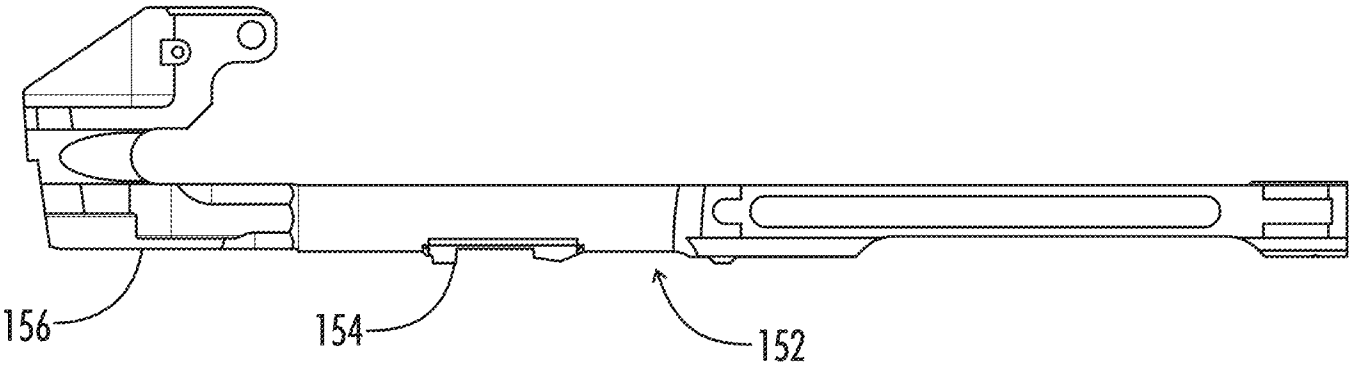
Figure 16:
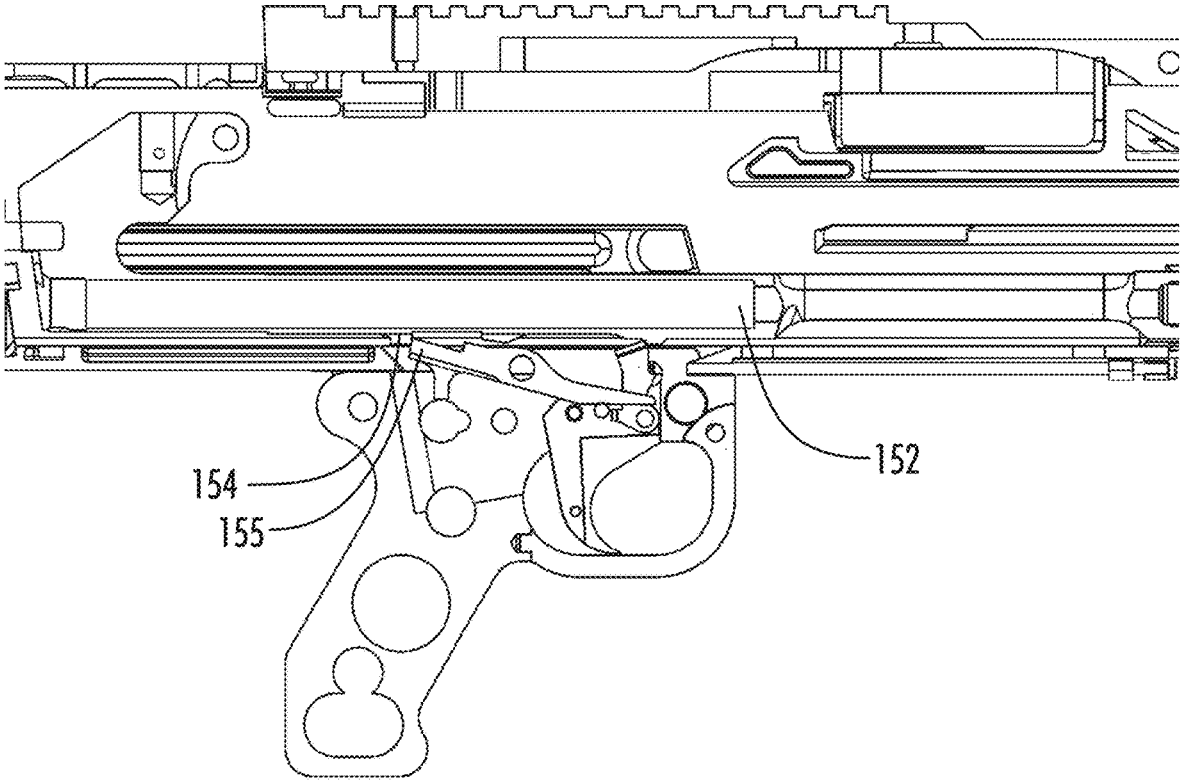
FIG. 16 is an illustration of a cutaway view of an optional embodiment of the operating rod.

Referring now to FIGS. 13*a* and 13*b*, there is an embodiment of a new operating rod assembly for a new M240 machine gun as described in the present disclosure. For example, for embodiments such as but not limited to those disclosed within FIG. 2 and FIG. 9, operating rod assembly 152 may be utilized. Specifically, operating rod assembly 152 may include forward sear engagement 154 rather than the traditional sear engagement 54 as located on the underside of rear section 56. As such, forward sear engagement 154 is positioned to interact with the sear per the forward position of trigger housing assembly 24. FIG. 16 provides a cross-sectional view illustrating operating rod assembly 152 with sear engagement 154 engaging the sear of the M240 machine gun. More specifically, in optional embodiments, sear 155 can engage sear engagement 154 in a more distal location on operating rod assembly 152 in comparison to prior art M240 machine guns. Generally, with the new operating rod assembly 152, the sear surface and ramp surface is located greater than two inches distally toward the muzzle when compared to the prior art operating rod assembly as depicted in FIGS. 12*a* and 12*b*. In some optional embodiments, the sear engagement is moved about 3.3 inches closer distally toward the muzzle in comparison.

Figure 14A:
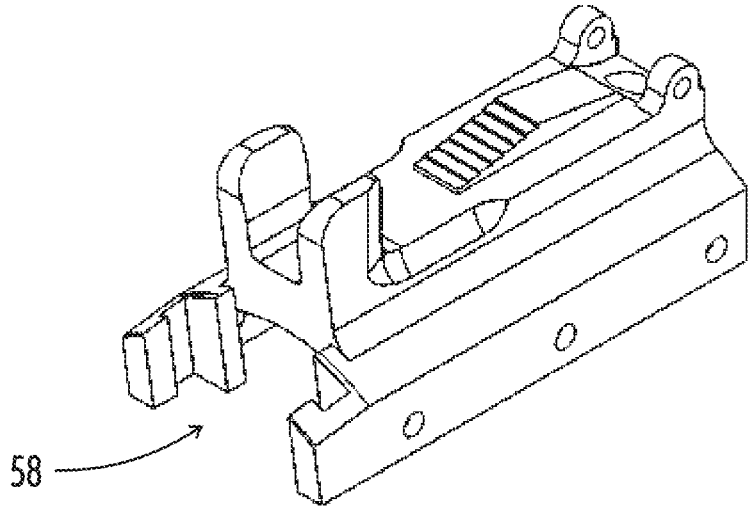
FIGS. 14*a* and 14*b* are illustrations of a sight for an M240 machine gun.
Figure 14B:
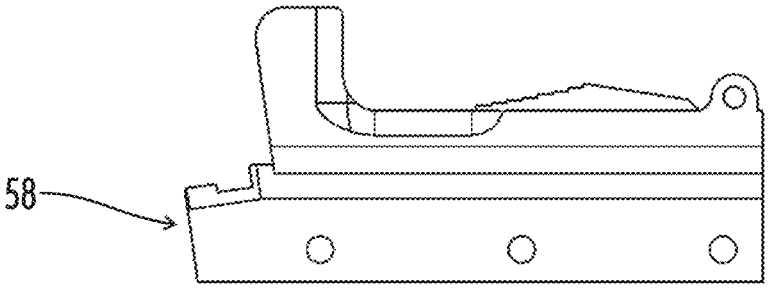
Figure 15A:
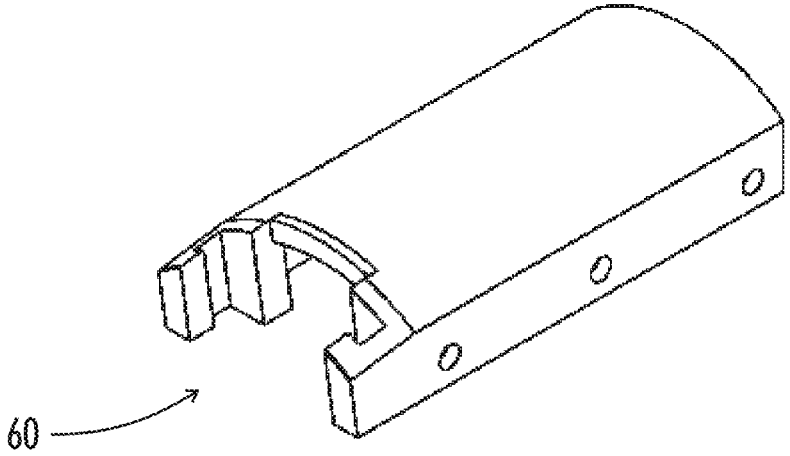
FIGS. 15*a* and 15*b* are illustrations of a cheek surface for an M240 machine gun.
Figure 15B:
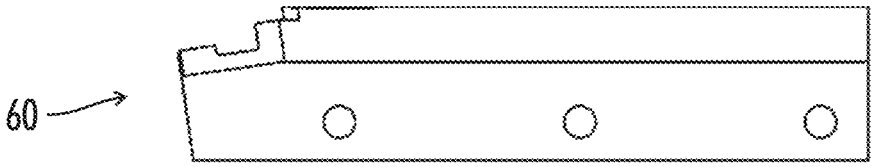

Referring now to FIGS. 14*a* and 14*b*, there is an embodiment of a rear sight that may be used with a M240 machine gun, the rear sight designated by the numeral 58. In optional embodiments, rear sight 58 may be attached to the upper receiver of M240 machine gun 10 as illustrated in FIG. 1. Additionally, other various embodiments of a rear sight may be used such as those for the M240LW as illustrated in FIG. 8. However, in some optional embodiments, a user may find it useful to have an area for a check rest on the receiver wherein the butt stock is shortened, for example in FIGS. 3, 5, 9, and 10. One embodiment of such receiver cheek rest is illustrated in FIGS. 15*a* and 15*b* and indicated by numeral 60. Such embodiment may provide a comfortable position for a user especially where the trigger housing assembly is in the forward position thereby causing the receiver of the firearm to be in a more rearward position toward the user's shoulder and face. In embodiments of the M240LW wherein unitary shells are utilized, optional embodiments of the cheek rest can be added to the shells upon formation of the receiver, or optionally, the cheek rest may be formed from the union of the shells.

Figure 17:
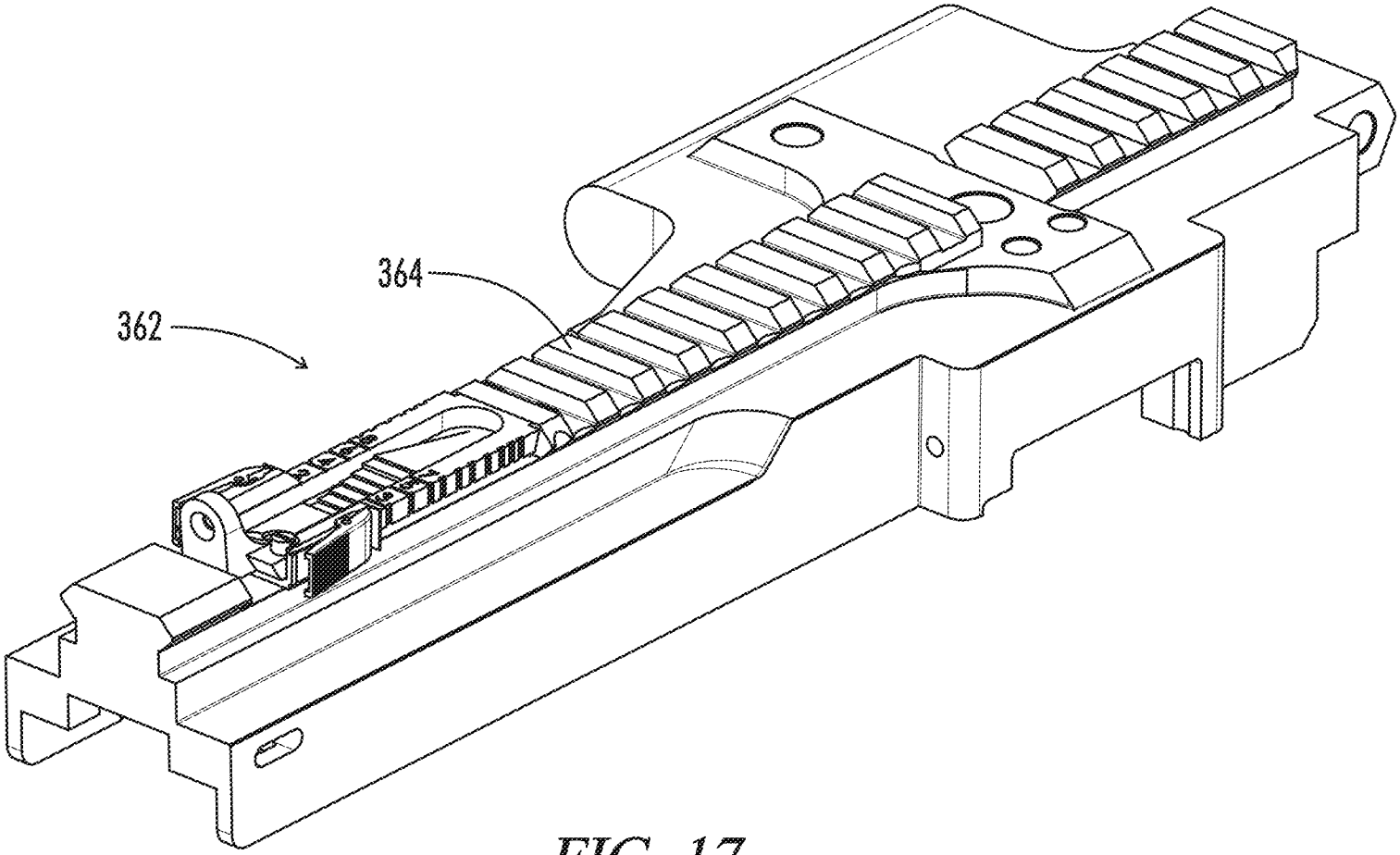
FIG. 17 is an illustration of an optional embodiment of a top rail.
Figure 18:
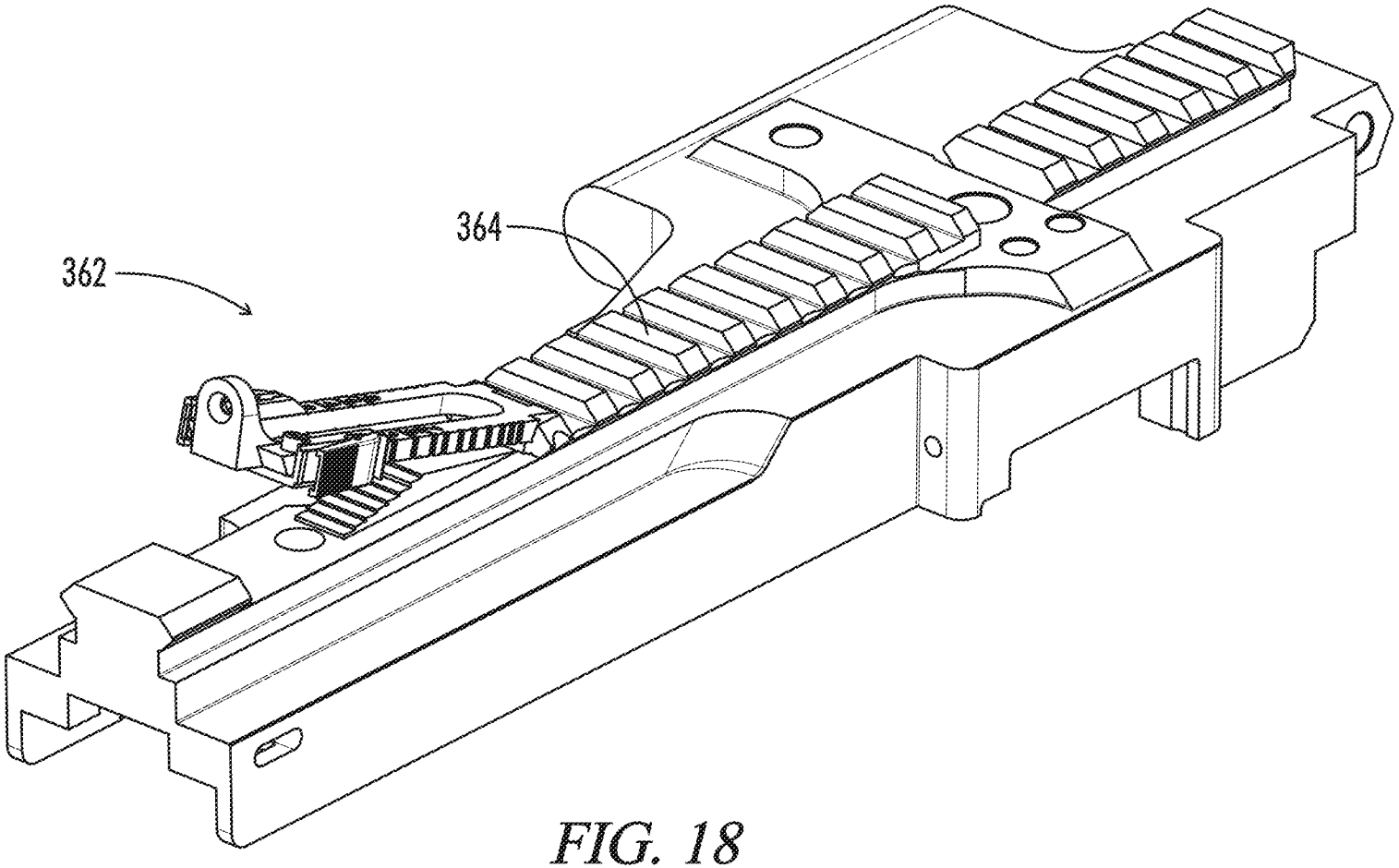
FIG. 18 is an illustration of an optional embodiment of a top rail with a raised rear sight.
Figure 19:
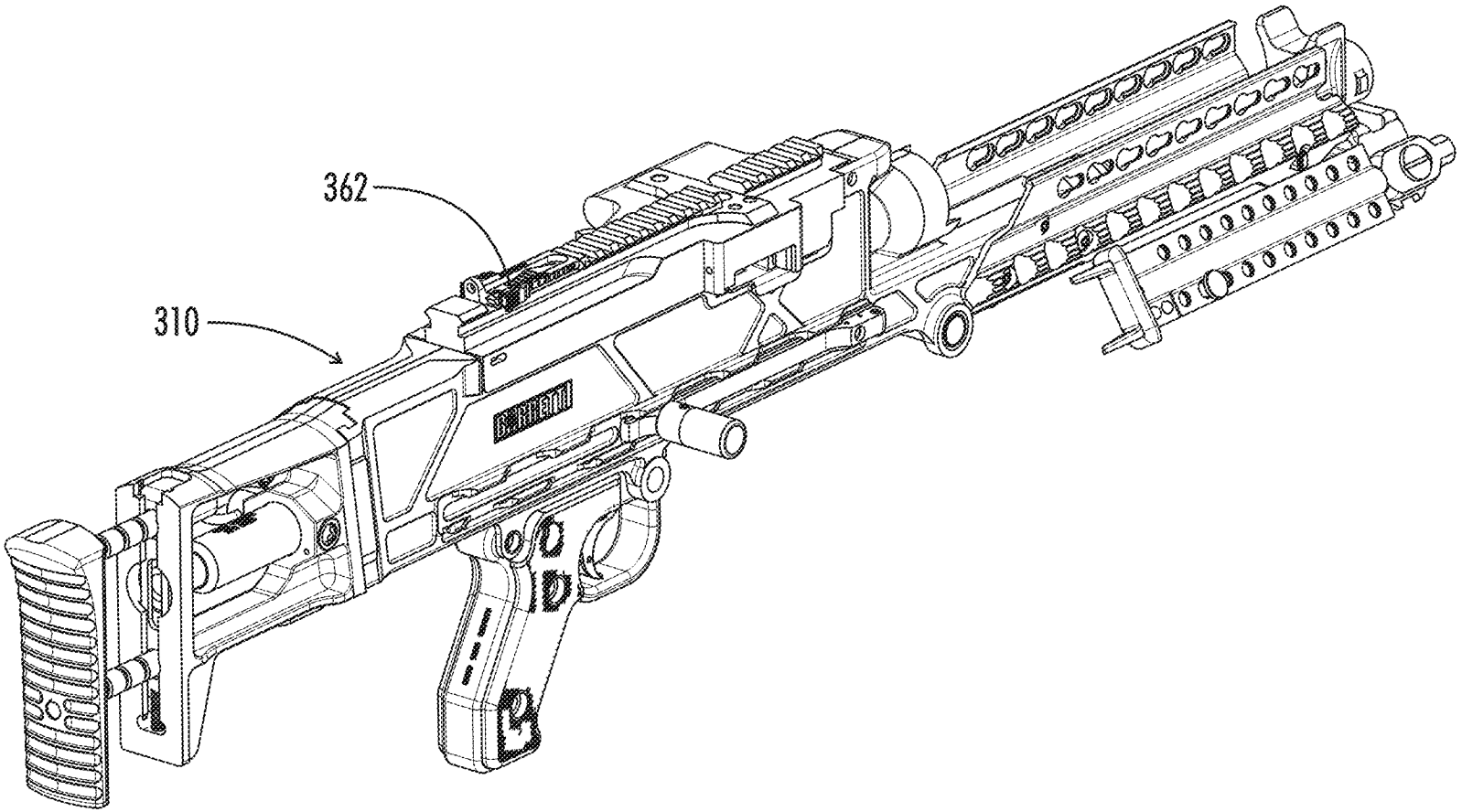
FIG. 19 is an illustration of an optional embodiment of a top rail mounted on an optional embodiment of a machine gun.

Referring now to FIGS. 17-19, there are illustrations of top cover 362. Top cover 362, in optional embodiments may be understood to be a top cover with an auxiliary Picatinny rail with an embedded rear sight. Generally, top cover 362 relocates the rear sight and incorporates it toward the rear of Picatinny section 364 so that the rear sight is ergonomically in a favorable position. In comparison to the prior art, the rear sight is moved distally forward so it will not disturb the cheek weld of the user. FIG. 17 illustrates the rear sight in the lower position while FIG. 18 depicts the rear sight in a raised position to illustrate how it may be used and adjusted for distance elevation. FIG. 19 illustrates top cover 362 in place on an optional embodiment of a 240LW machine gun. As one can see, the rear sight of top cover 362 is moved distally forward thus providing space for a cheek weld for a user.

Furthermore as used herein, shortened butt stock 112 is often shown with various embodiments of the invention. Such is not mean to be limiting, but rather illustrate one possible embodiment of a shortened butt stock. In some optional embodiments, the shortened butt stock is shortened to a length just to contain the hydraulic buffer system. In yet other optional embodiments, a collapsible stock may be used with the firearm. Even with differing types of stocks being used with optional embodiments of the M240 machine gun, the trigger housing assembly may still be positioned in a forward position to provide for greater ease in using such firearm.

As such, the adapters or extended trigger assemblies in various embodiments allow for the use of a shorter butt stock on an M240 machine gun, including the M240LW machine gun, as the grip and trigger are moved distally forward. Additionally, new M240 machine guns may be manufactured per the embodiments described herein. Thus, significant weight savings may be realized as well as better balance and usability of the weapon platform. As a shorter butt stock can be used with the grip placed distally forward, a user may be able to maneuver the machine gun in an improved fashion.

As used herein, "forward position" refers to a position located more distally than the prior art M240 machine gun as illustrated in example one for example. Some may understand this to mean the trigger housing assembly is located about adjacent to the ejection port or alternative at about the central area of the main portion of the receiver. In some further optional embodiments, the trigger housing assembly may be moved distally on the receiver so that it is at least about two inches from the proximal end of the receiver.

Various accessories may also is be used with embodiments of the machine gun as described herein, including both a handguard and a mount. As disclosed in FIGS. 20 through 32, handguard 250 and/or bipod 262 can be used with either of the previously disclosed receivers manufactured by Barrett Firearms Manufacturing, such receivers being previously designated with the numerals 218 and 318. For purposes of clarity of this disclosure, handguard 250 is describe in relation to receiver 218 and machine gun 210 though may be used with receiver 318 and machine gun 310 or other variants. Furthermore, it is understood that other receiver designs may work similarly with optional embodiments of handguard 250. Thus, as used herein, handguard 250 has distal end 252 and proximal end 254 and may attach to attaches to receiver 218 of machine gun 210. Optionally, bipod 262 may attach to handguard 250 so as to provide support to a user.

Figure 20:
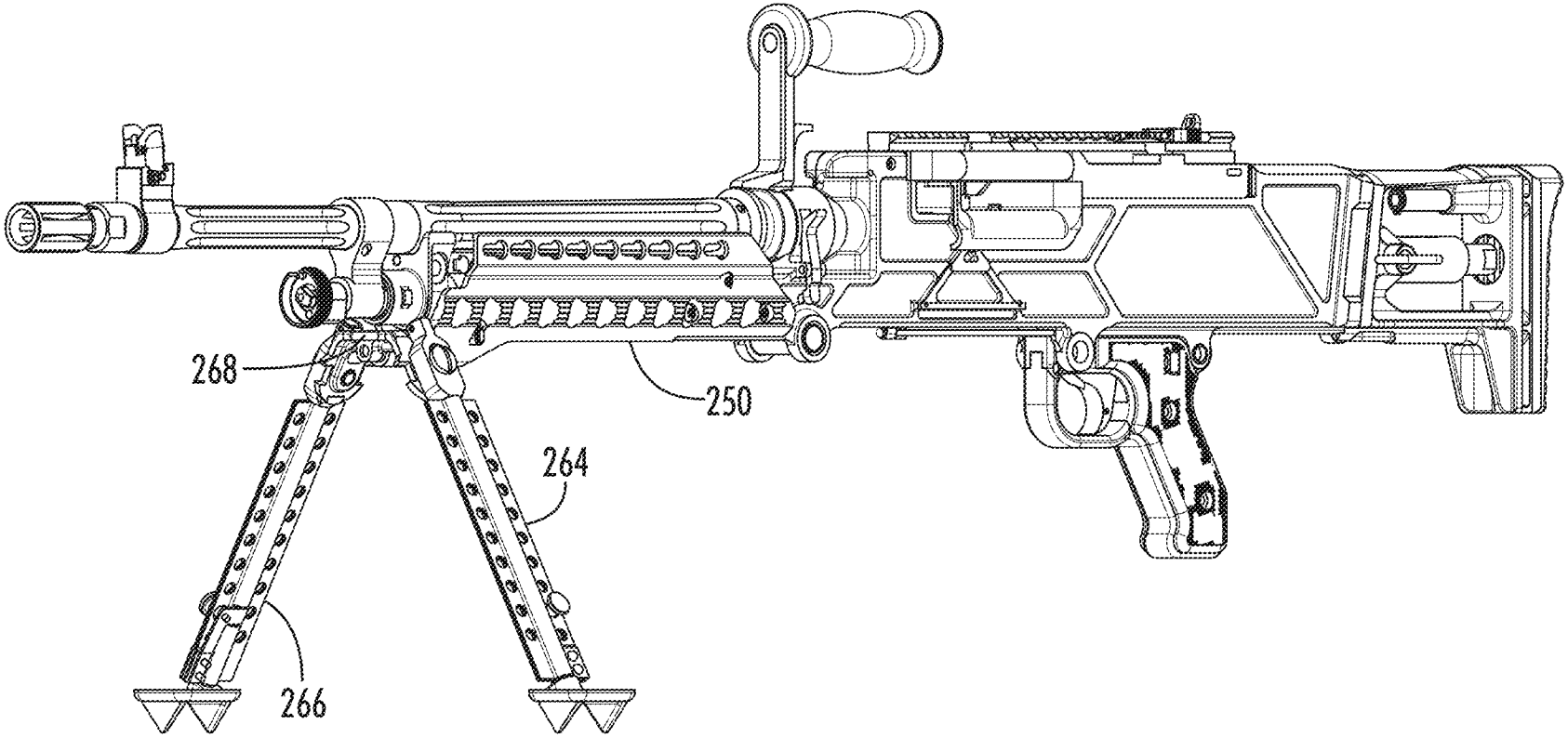
FIG. 20 is an illustration of an optional embodiment of a handguard attached to a machine gun.
Figure 21:
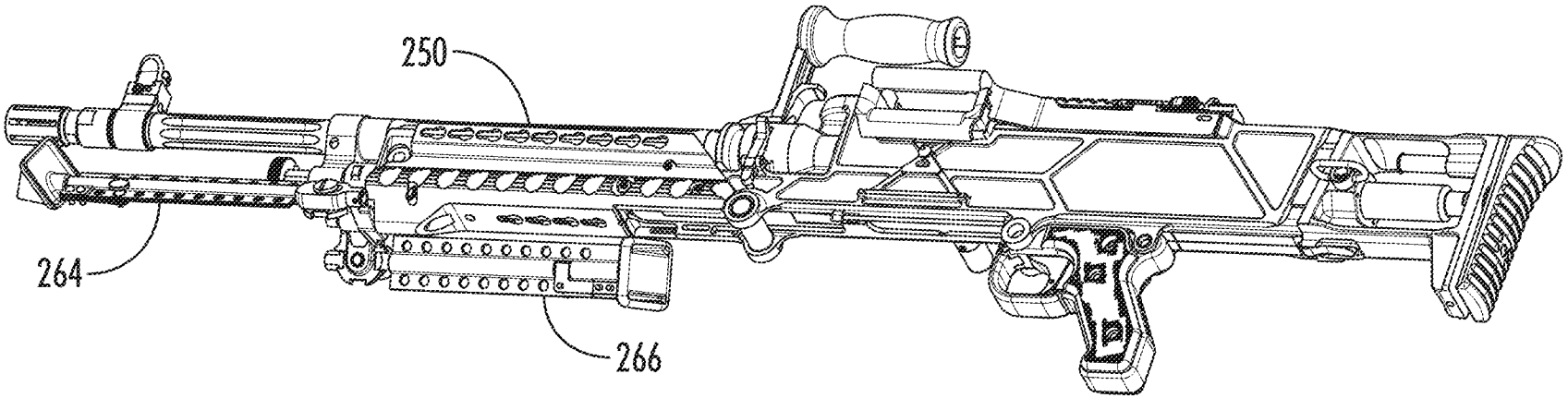
FIG. 21 is an illustration of an optional embodiment of the handguard attached to a machine gun.

Generally bipod 262 may include first leg 264 and second leg 266 attached to main bipod body 268 as illustrated in FIG. 21, the bipod legs 264 and 266 being rotatably connected to bipod body 268 so that the user may orient the bipod legs into the orientation the user may such desire. Thus, as illustrated in FIG. 20, bipod legs 264 and 266 may be oriented in a downward position to provide support when firing the machine gun 210 or alternatively may be folded or rotated in a variety of orientations to suit the user's desires.

Figure 22:
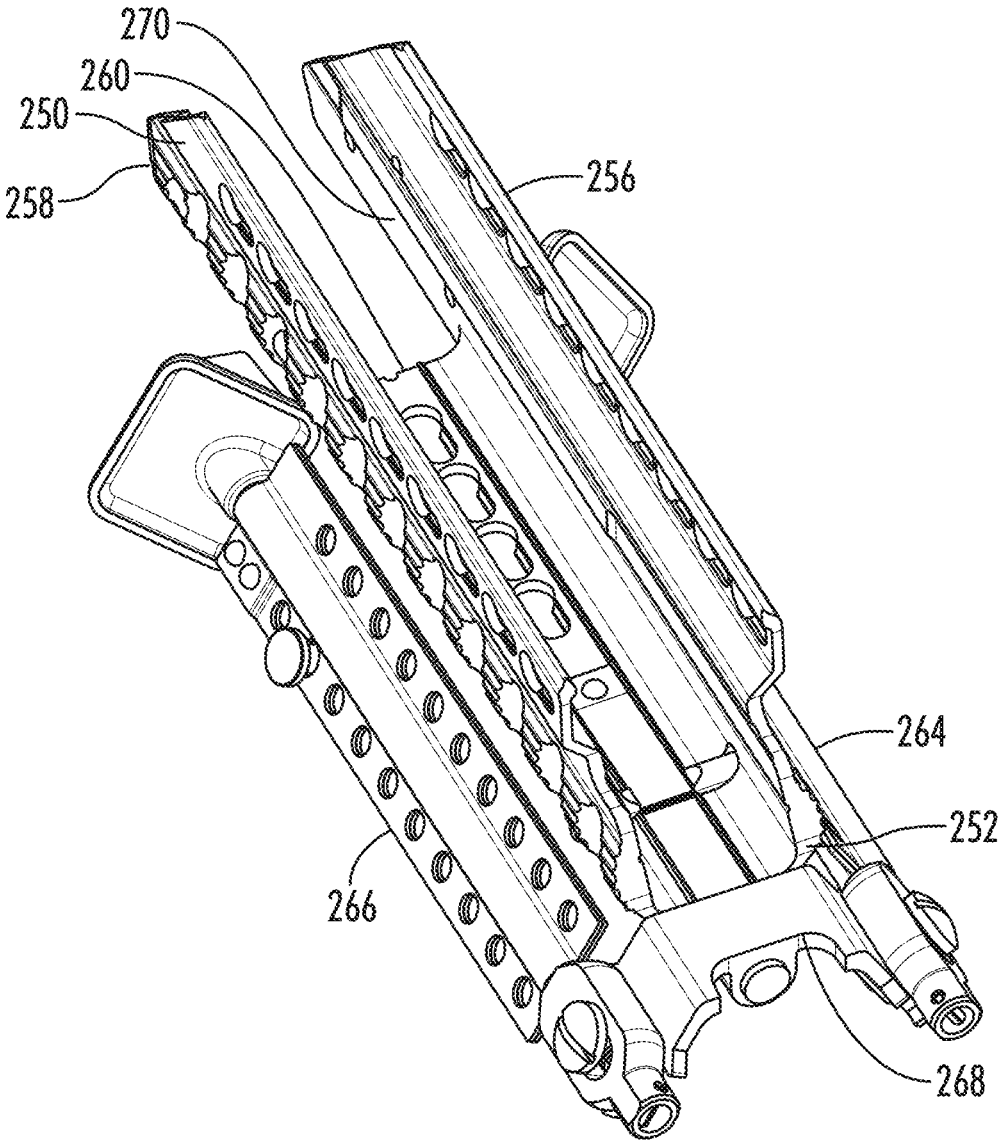
FIG. 22 is an illustration of an optional embodiment of the handguard with an optional embodiment of the bipod assembly attached.

Referring now to FIG. 22, there is an illustration of handguard 250 and bipod 262 separate from machine gun 210 with first leg 264 and second leg 266 folded back along the sides of handguard 250. As used throughout this disclosure, handguard 250 has first handguard side 256, second handguard side 258 and bottom handguard side 260. Generally first side 256 is understood to be the left side of the firearm from the point of view of the user when firing the firearm whereas second side 258 is understood to be the right side of the handguard as understood from point of view of the user firing the firearm. Bottom side 260 is generally understood to go about the bottom area of the firearm and thus connect first side 256 and second side 258. In optional embodiments where handguard 250 includes a design in which the handguard is more circular or oval in shape, generally the left side of the handguard would be understood to be first side 256 whereas the right side of the handguard would be understood to be second side 258 despite the handguard having a generally round design. When bipod 262 is attached to handguard 250, bipod 262 generally attaches to the distal end 252 of handguard 250.

Figure 23:
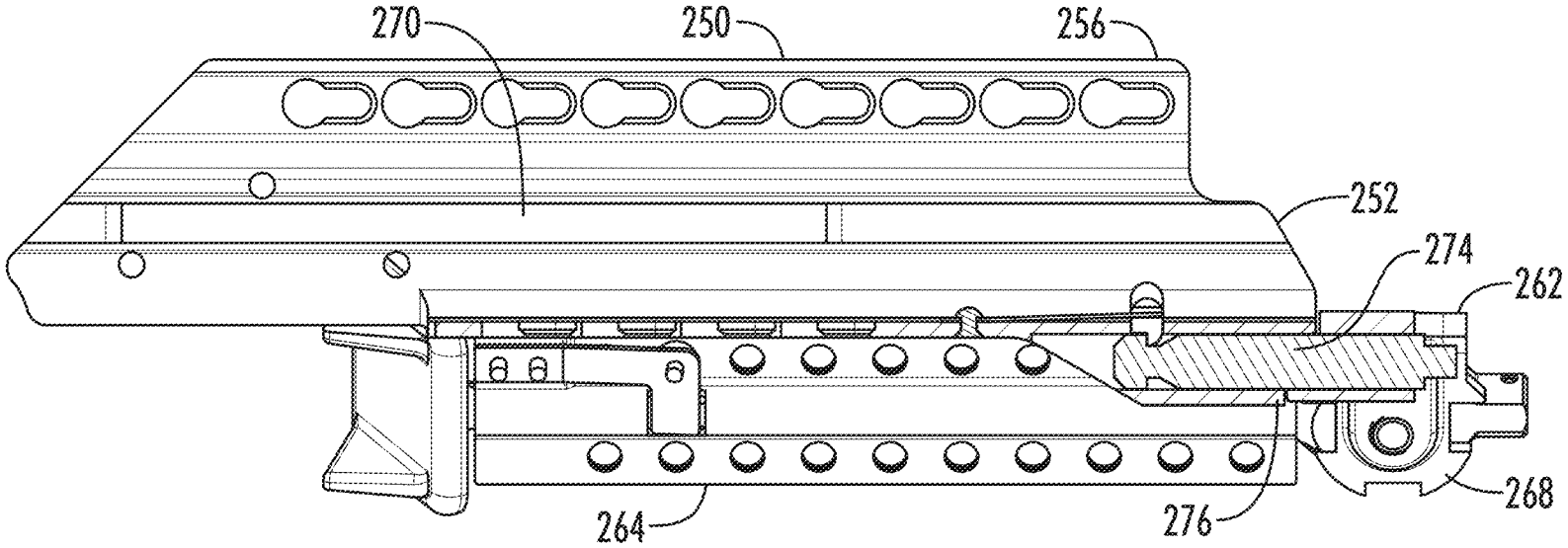
FIG. 23 is an illustration of an optional embodiment of the handguard with an optional embodiment of the bipod assembly attached.

Referring now to FIG. 23, there is a cross-sectional view of handguard 250 with bipod 262 attached. The cross-sectional view is taken through about the middle of bottom side 260 of handguard 250. Here in FIG. 23 one can also see interior surface 270 of handguard 250. FIG. 23 also includes first side 256 of handguard 250 and illustrates first leg 264 of bipod 262 while providing a view of pintle 274 of bipod body 268 of bipod 262 engaged within pintle mount 276 at distal end 252 of handguard 250. Through use of pintle 274 on bipod body 268 of bipod 262 that engages pintle mount 276 of handguard 250, bipod 262 may be removably attachable to handguard 250. Advantageously, through such engagement, pressure that may be exerted by bipod 262 upon machine gun 210 with handguard 250 is exerted upon handguard 250 rather than the pressure being applied to the gas block of the machine gun. Thus, the use of handguard 250 with bipod 262 may result in less deviation in the direction of fire when using a bipod as handguard 250 engages receiver 218 of machine gun 210 rather than the gas assembly.

Figure 24:
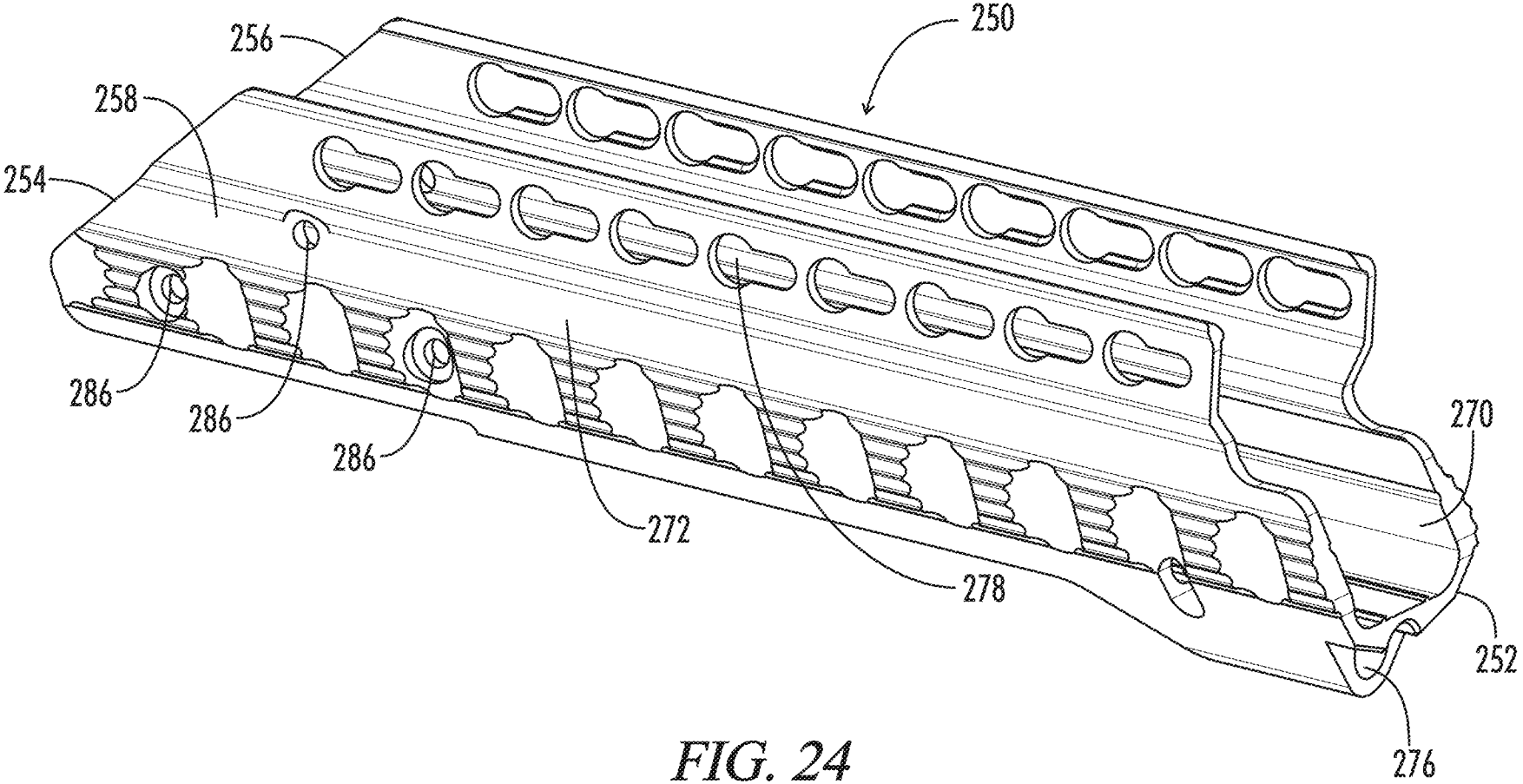
FIG. 24 is an illustration of a side perspective view of an optional embodiment of the handguard.

Referring now to FIG. 24, there is an illustration of handguard 250 without bipod 262 and also additionally without machine gun 210. This illustration provides a view of interior surface 270, exterior surface 272 as well as pintle mount 276, proximal handguard end 254, distal handguard end 252 and second side 258 of handguard 250. Additionally, interface system 278 is visible and can be seen on both first handguard side 256 and second handguard side 258. Generally, interface system 278 and optional embodiments may be included on either first side 256, second side 258 and/or bottom side 260 and may be used to affix accessories to the handguard. Such accessories may vary from lights to grips to laser indicators and the like among other various firearm accessory components. In optional embodiments, interface system 278 may embody a KeyMod style of interface as is illustrated throughout this application. Other interface systems may also be used including the Picatinny style rail style interface, also known as MIL-STD-1913 rail, and other style of mounting systems that are used within the firearm industry. In optional embodiments, interface system 278 may be present on multiple sides of handguard 250 as is illustrated throughout the various figures of this disclosure. Yet in further optional embodiments, interface system 278 may be absent from handguard 250. Despite having no interface system, handguard 250 could still in optional embodiments provide for connection to a bipod as pintle mount 276 could still be present. In yet further optional embodiments, pintle mount 276 may or may not be present as some uses of machine gun 210 may not require or be designed for use with bipod 262.

Figure 25:
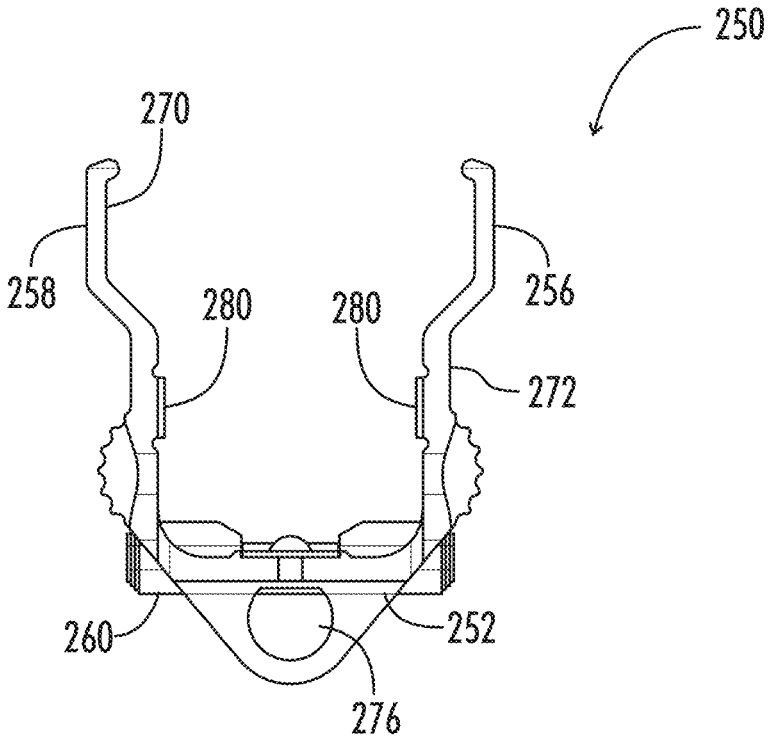
FIG. 25 is an illustration of a front view of an optional embodiment of the handguard.

Referring now to FIG. 25, there is a view of handguard 250 from distal end 252 of handguard 250. Here one can see pintle mount 276 as well as first handguard side 256, second handguard side 258 and bottom handguard side 260 as well as exterior surface 272 and interior surface 270. Additionally from such viewpoint one can also see bosses 280 on interior surface 270 of handguard 250. Bosses 280 may optionally be present to engage slots 282 on receiver 218 of machine gun 210. As used herein, boss refers to a raised portion that may generally fit to a corresponding slot or recess. Furthermore as used herein, slot generally refers to a recessed opening, valley, or indentation for which a boss may fit there within. The use of one or more bosses 280 on handguard 250 to correspond to one or more slots 282 on receiver 218 of machine gun 210 provides for a mechanically strong joint.

In optional embodiments, two bosses may be included, one on first side 256 of handguard 250 and another boss 280 on the second side 258 of handguard 250, which both correspond to slots 282 on receiver 218 of handguard 250. While the general optional embodiments describe two bosses 280, further embodiments may include a greater or lesser amount of bosses depending upon the specific design of the receiver. In some optional embodiments bosses 280 may be absent with the handguard 20 attaching with other means.

Figure 26:
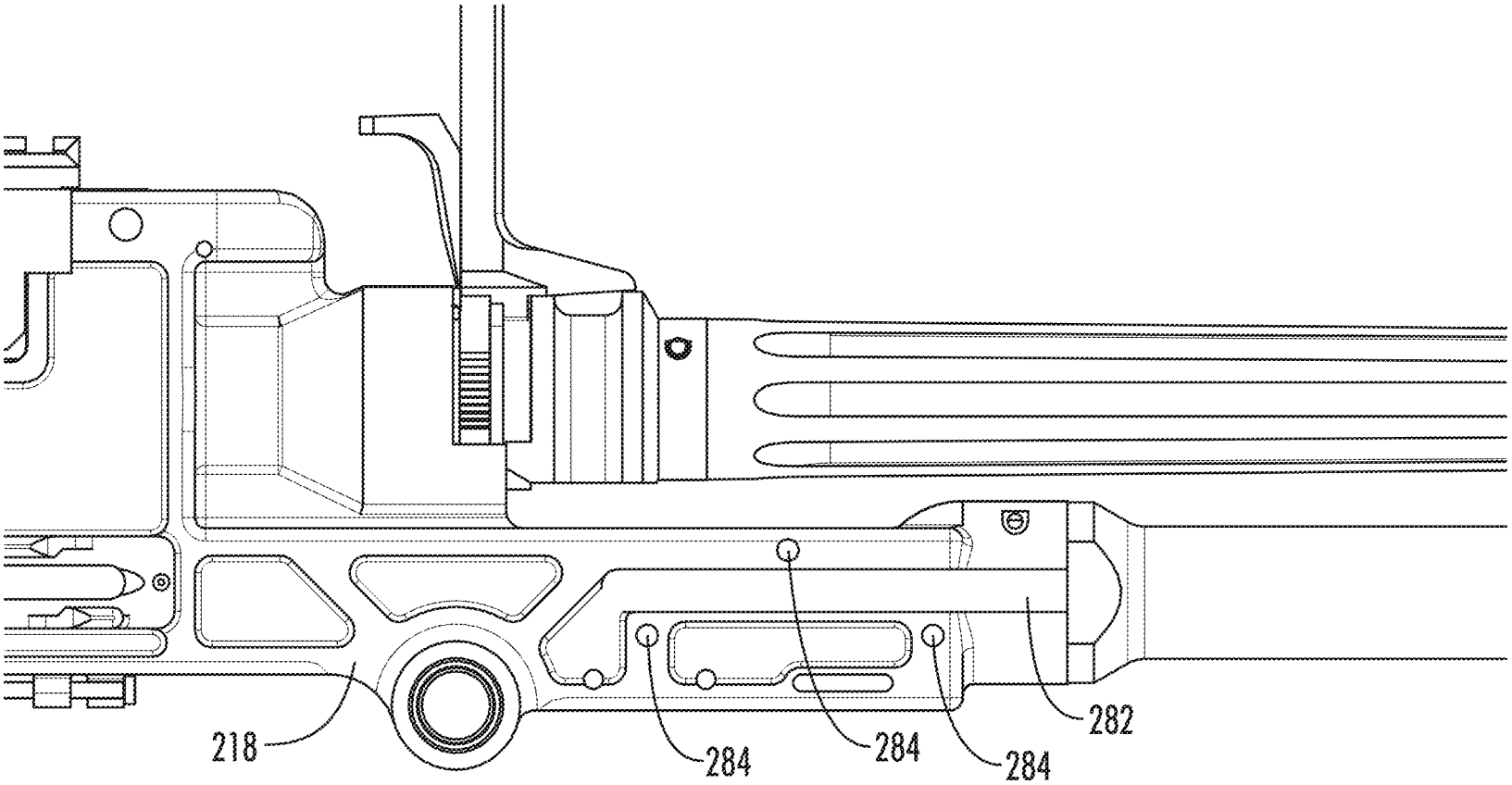
FIG. 26 is an illustration of the receiver of a machine gun where the receiver communicates with an optional embodiment of the handguard.

FIG. 26 illustrates receiver 218 with a slot 282 that can engage boss 280 on the interior surface 270 of second side 258 of handguard 20. Additionally visible on FIG. 26 are mounting points 284 which correspond to attachment point 286 on handguard 250. As illustrated in some of the subsequent drawings, mounting point 284 of receiver 218 generally align with attachment points 286 of handguard 250 so that handguard 250 may be secured to receiver 218 of machine gun 210. In yet further optional embodiments, attachment hardware 288 may be used to engage both mounting point 284 and attachment point 286 and thus attach handguard 250 to machine gun 210. In optional embodiments, attachment hardware 288 may be a variety of different screws including screws having a size of #10-32. In some optional embodiments, attachment hardware may include a variety of different screws including torque screws as well as screws that may be engaged by Allen wrenches, various screwdrivers or the like.

Figure 27:
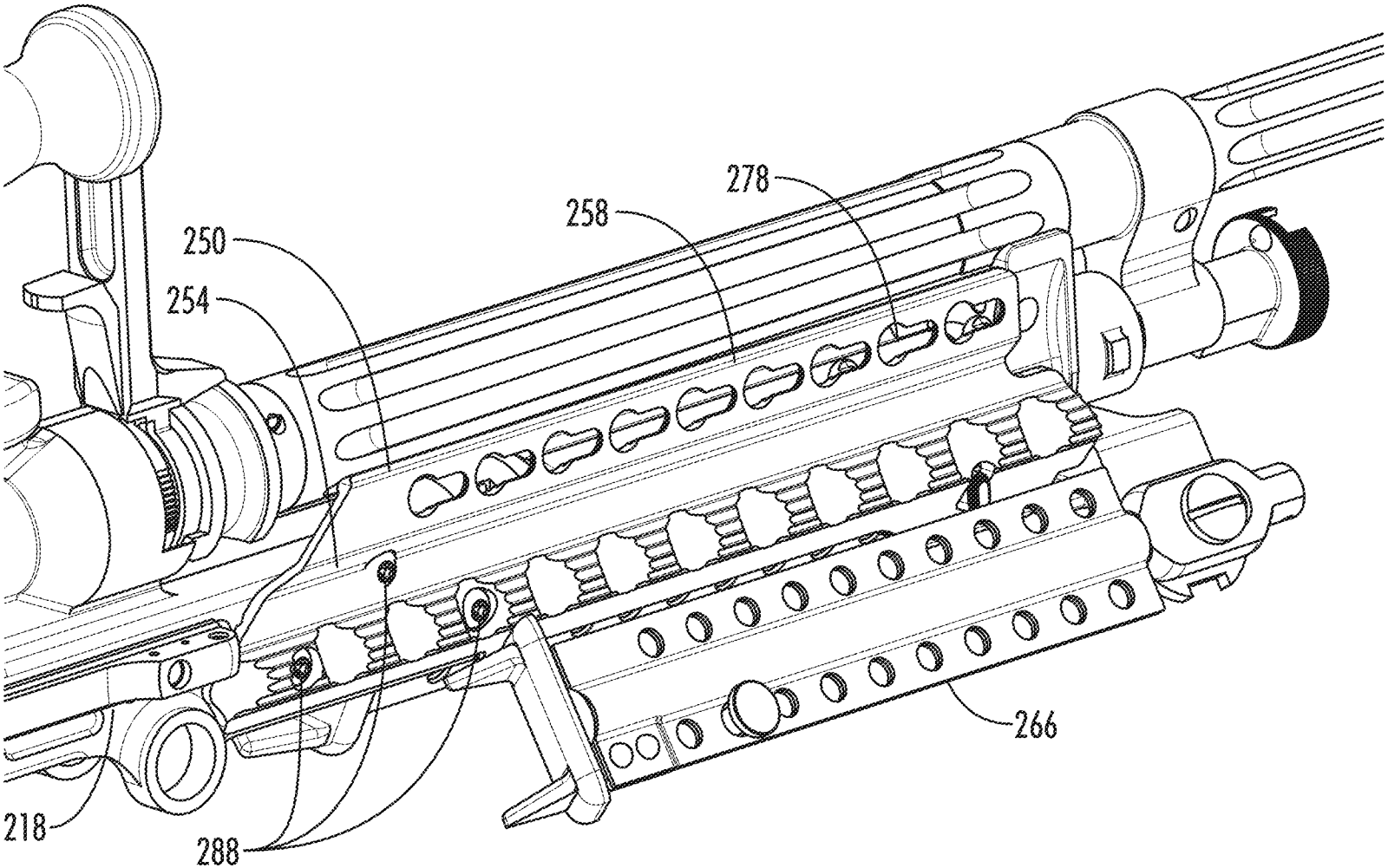
FIG. 27 is an illustration of a close up view of an optional embodiment of the handguard attached to a machine gun.
Figure 28:
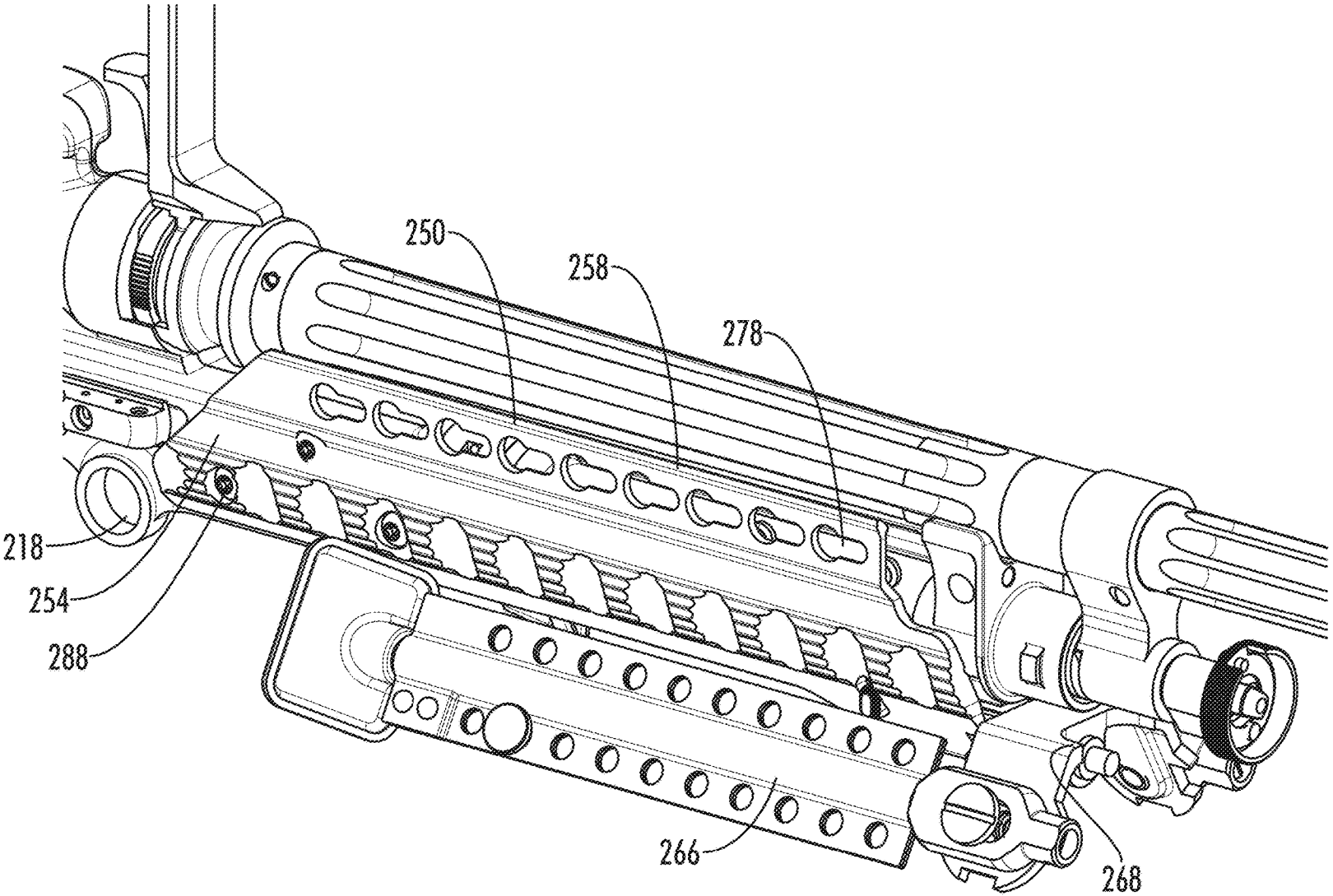
FIG. 28 is an illustration of a close up view of an optional embodiment of the handguard attached to a machine gun.

As illustrated throughout various figures of the optional embodiment of handguard 250, three attachment points 286 may be positioned at about proximal end 254 of handguard 250 on both first side 256 of handguard 20 and second side 258 of handguard 20. In such optional embodiments, receiver 218 may have at least about six mounting points 284 that can correspond to six attachment points 286 on of handguard 250. FIG. 27 illustrates an optional embodiment of handguard 250 installed on receiver 218 of machine gun 210 with attachment hardware 288 in place.

Figure 29:
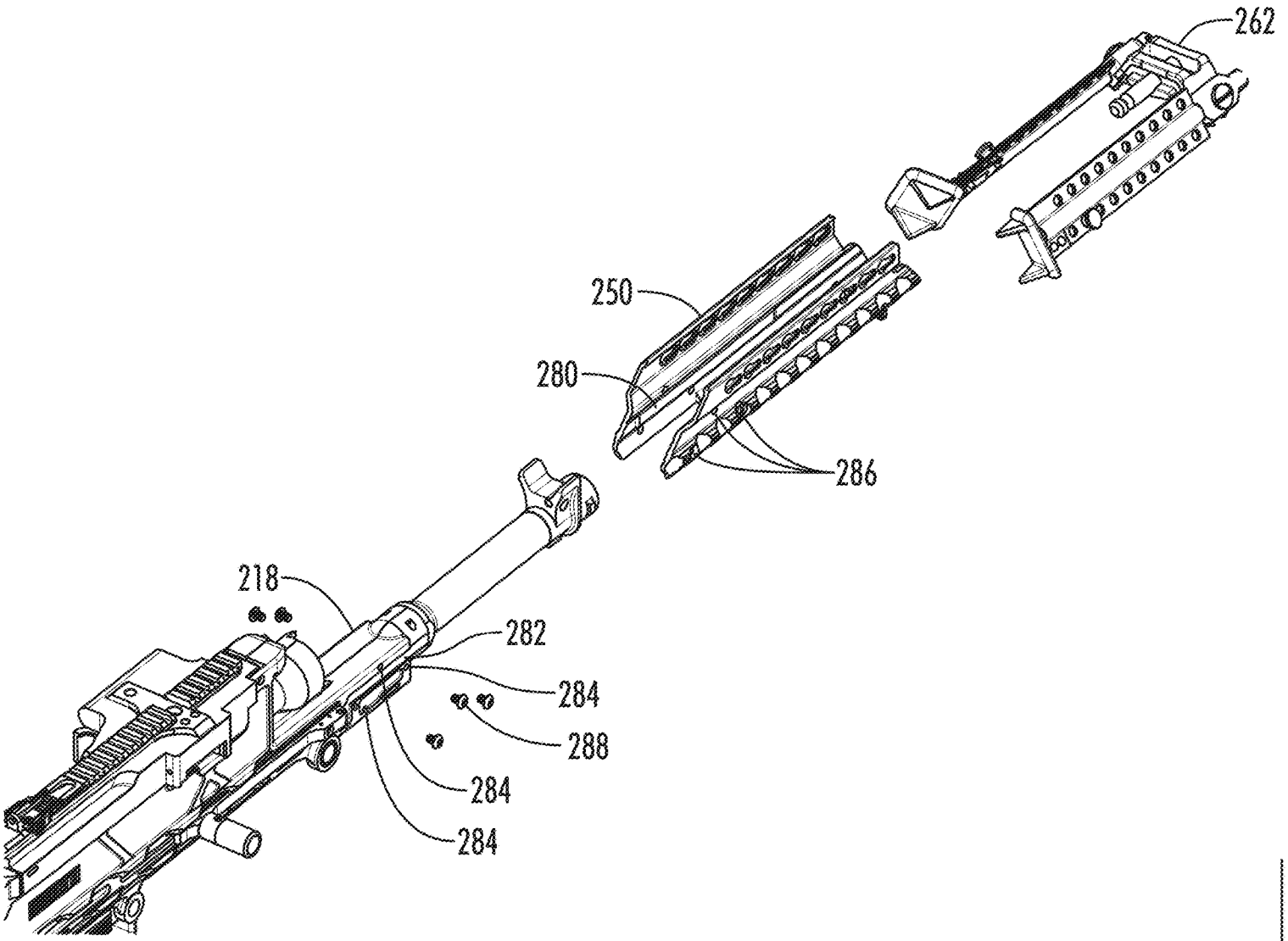
FIG. 29 is an illustration of an exploded view of the machine gun without barrel with an optional embodiment of the handguard and an optional embodiment of a bipod assembly.
Figure 30:
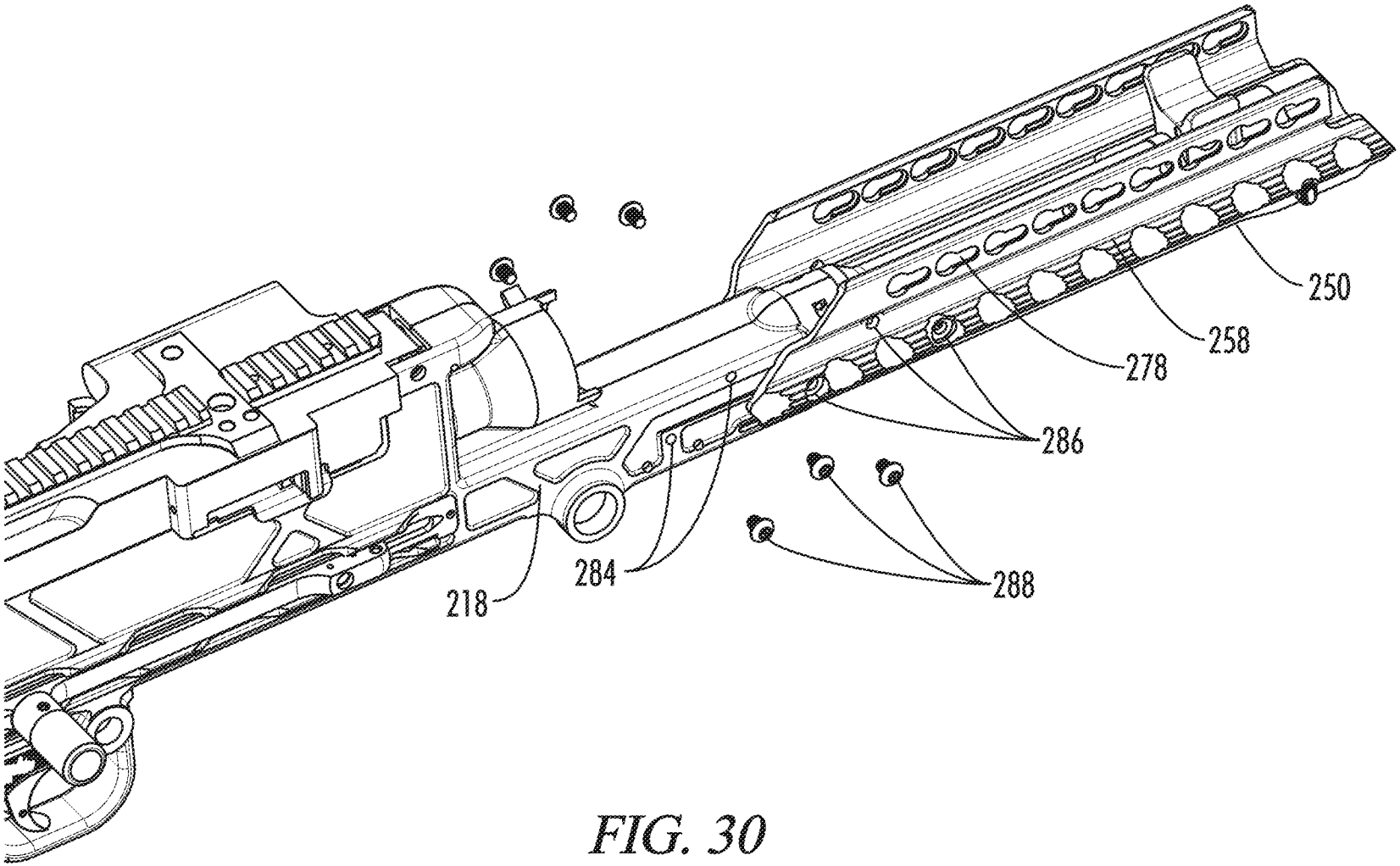
FIG. 30 is an illustration of an optional embodiment of the handguard with the receiver of a machine gun.
Figure 31:
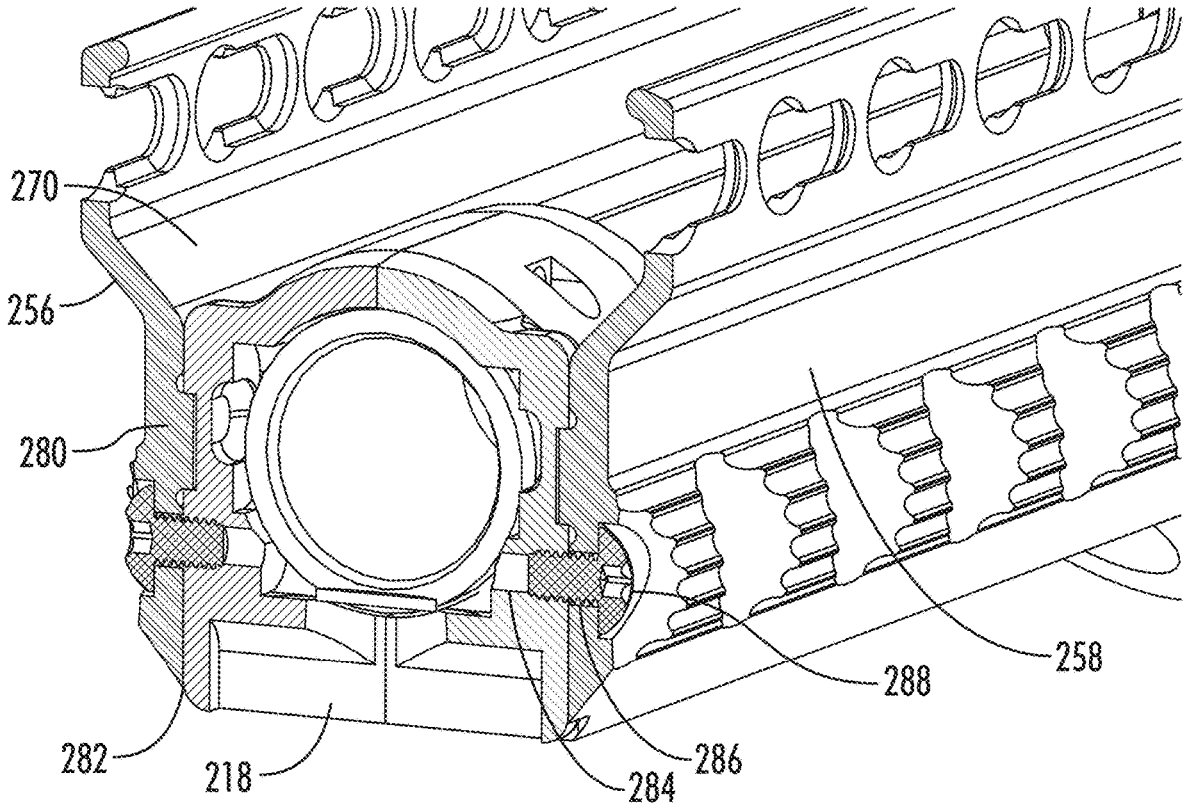
FIG. 31 is an illustration of a cross-sectional view of an optional embodiment of the handguard attached to a machine gun.

FIGS. 29 and 30 illustrate exploded views to further indicate how one or more bosses 280 of handguard 250 align with one or more slots 282 of receiver 218 as well as how mounting points 284 can correspond with attachment point 286 for attachment hardware 288. Such illustrations are provided with the barrel removed from machine gun 210 to provide greater clarity in explaining the engagement of handguard 20 to receiver 14. FIG. 15 is a cutaway view through a mounting point 284 and attachment point 286 with attachment hardware 288 in place in this optional embodiments. Additionally, through this illustration one can see how bosses 280 of handguard 250 engage slots 282 of receiver 218. In further optional embodiments lesser or greater numbers of attachment points, mounting points, and/or attachment hardware may be utilized.

Figure 32:
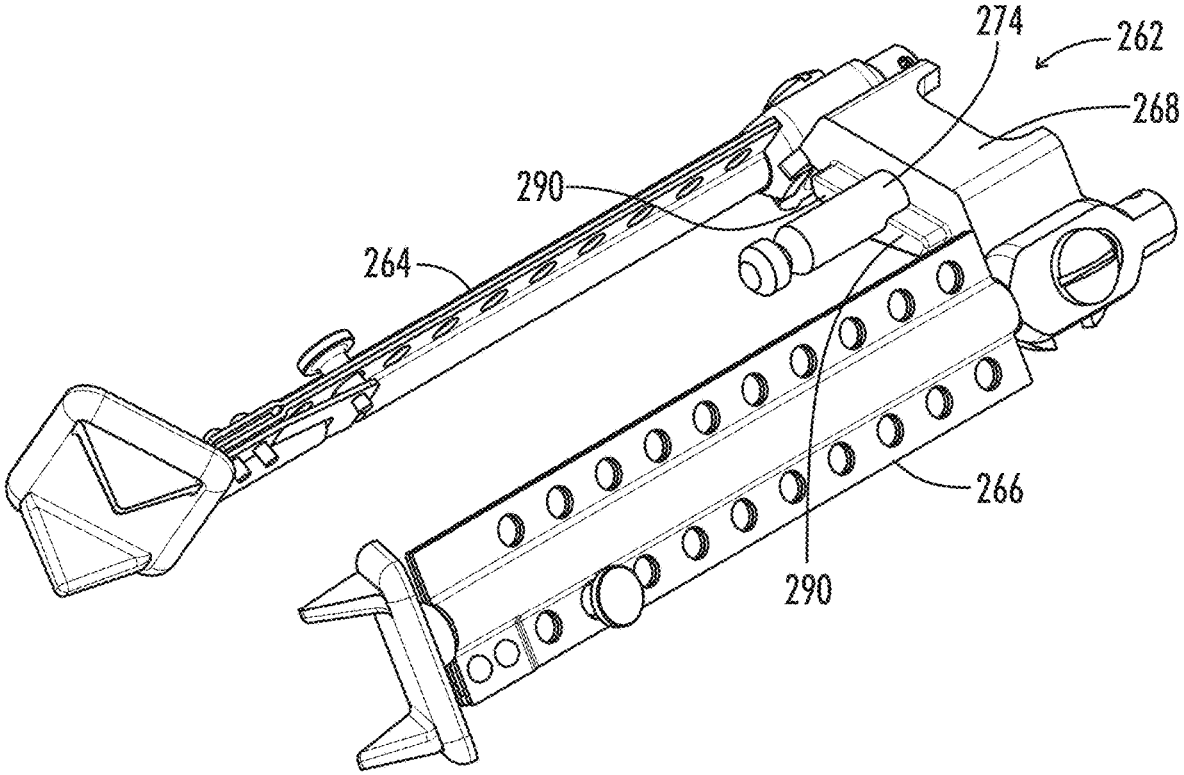
FIG. 32 is an illustration of an optional embodiment of a bipod assembly.
Figure 33:
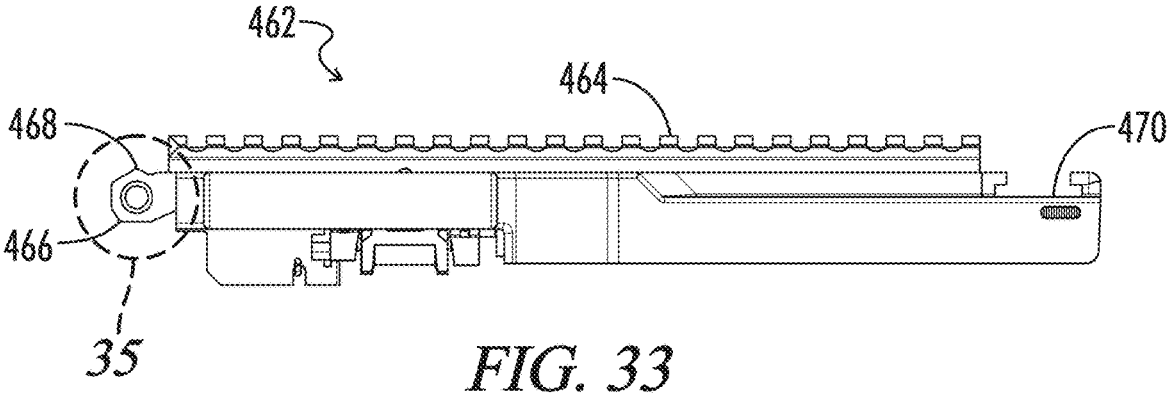
FIG. 33 is an illustration of an optional embodiment of a top cover.
Figure 34:
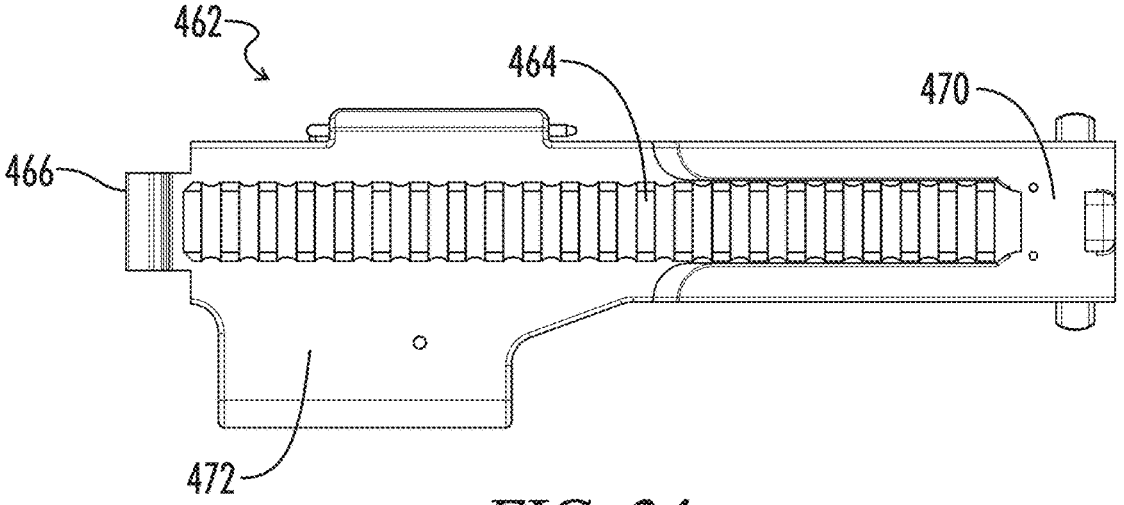
FIG. 34 is another illustration of the optional embodiment of a top cover.

Now referring to FIG. 32, there is an illustration of bipod 262 as discussed earlier. Pintle 274 is positioned on bipod body 268 with first leg 264 and second leg 266 also affixed to bipod body 268. With bipod 262 removed from handguard 250, one can see bipod bosses 290 adjacent to pintle 274. In use, bipod bosses 290 may be used to limit the rotation of bipod 262 relative to handguard 250 when attached to handguard 250. This may provide for greater stability in operation of machine gun 210. In yet further optional embodiments, bipod 262 may not include bipod bosses 290 so as to provide for greater rotational freedom if such is desired. Yet in further optional embodiments, lesser or more bosses 290 may be present depending upon the corresponding structure of distal end 252 of handguard 250.

As such, the handguard as described in various optional embodiments provides for greater usability and improvement upon the M240 variant machine guns. As handguard 250 affixes to the receiver of a machine gun, force upon handguard 250 advantageously delivers such force to the receiver as opposed to delivering it to the barrel assembly or gas assembly. Generally, this results in less deviation in the actual impact of shots fired from the machine gun relative to the intended point of aim. Furthermore, the use of interface systems allows for a variety of useful accessories to be used with such a firearm.

Further advantages that may be realized are that the barrel may be changed in some optional embodiments without requiring the removal of the handguard. In further optional embodiments not illustrated, the handguard may span across the top of the barrel in addition to spanning below the gas assembly and barrel.

Generally, the handguard may be constructed of a variety of different materials. One such option includes the handguard being formed or extruded from various different types of aluminum including 5000, 6000, or 7,000 series aluminum which may optionally include, without limitation, tempered aluminum alloys, examples of which may be 6061-T6, 7075-T651, or 7050-T7651. In further optional embodiments, other materials may be utilized which can include different types of heat treatable alloys or stainless steels such as 17-4PH. In other embodiments, the handguard could be formed from a weldment or cast or alternatively from various alloys ranging from magnesium to titanium alloy or possibly even composite materials.

Referring now to FIGS. **33-36*b*, there are various illustrations of an embodiment of a top cover designated by the numeral 462. Top cover 462 includes attachment interface 464, receiver connection point 466, and rear sight attachment 470**.

Figure 36A:
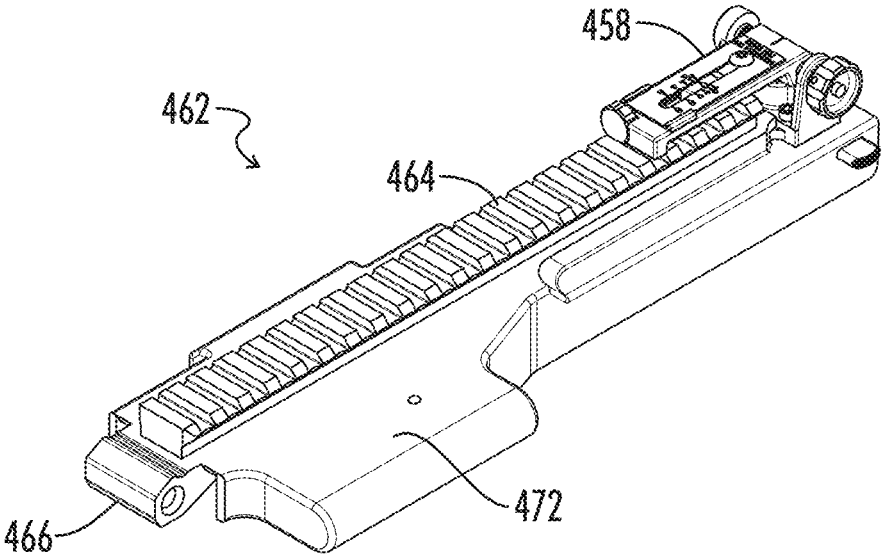
FIG. 36*a* is an illustration of an optional embodiment of a top cover with a rear sight folded down.
Figure 36B:
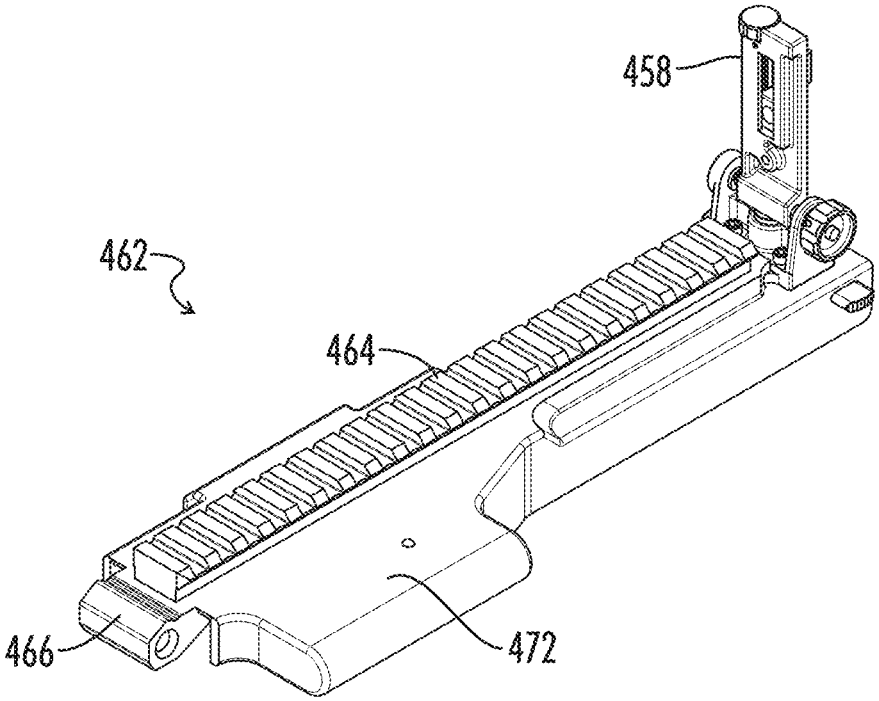
FIG. 36*b* is an illustration of an optional embodiment of a top cover with a rear sight erect.

Generally, rear sight attachment 470 is designed so a rear sight may be attachable to top cover 462. In some optional embodiments, rear sight 458 may fold so as to provide a more compact arrangement for the user. An illustration of folding sight 458 at rear sight attachment 470 is included in FIGS. **36*a* and 36*b*. As illustrated in FIG. 36*a*, rear sight 458 may fold and generally lay about flush with top cover 462. When desired for use, rear sight 458 may be oriented in an erect fashion as illustrated in FIG. 36*b*. As the rear sight of a traditional M240 machine gun was fixed, a user has improved adaptability with rear sight attachment 470 as rear sight 458 can even be completely removed. Optionally, rear sight attachment 470** may be operable to fit the rear sight of a Barrett M107A1.

Figure 41:
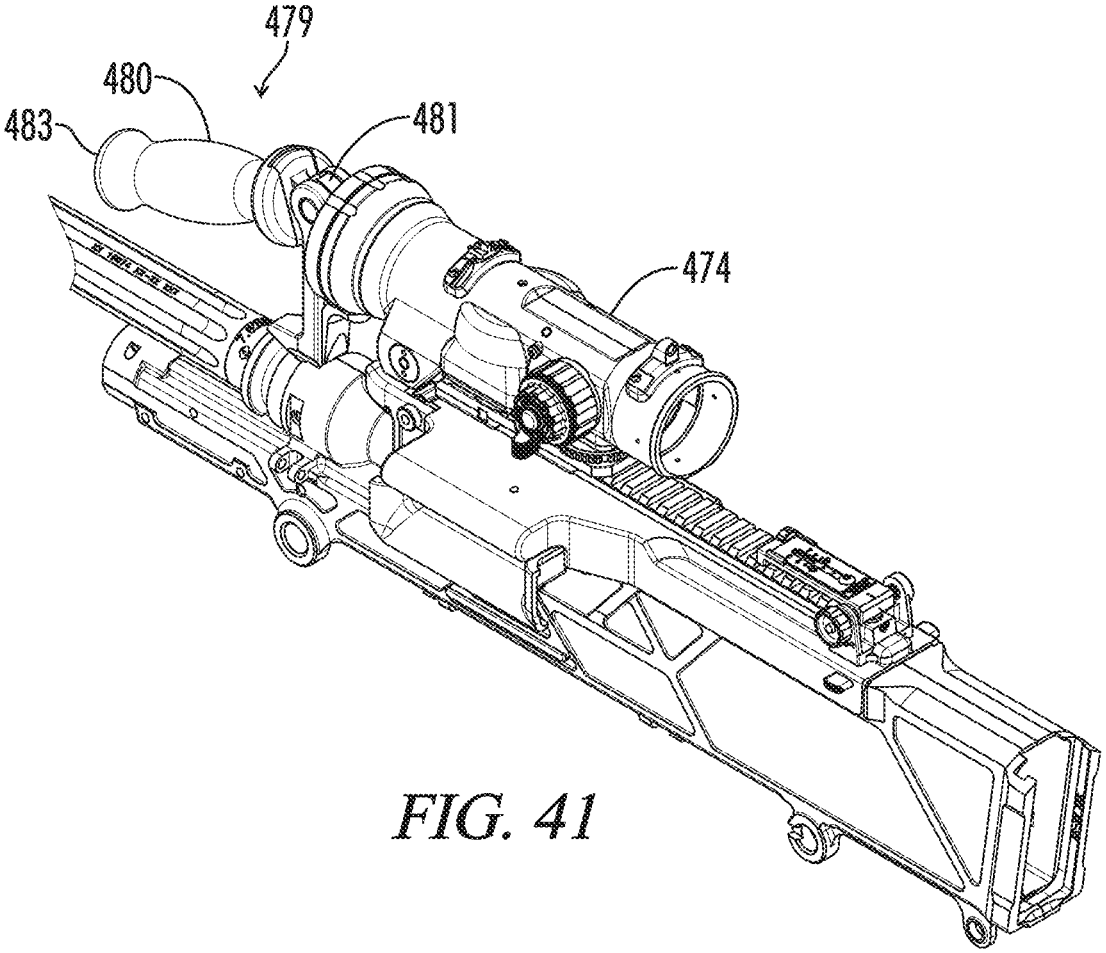
FIG. 41 is an illustration of an optional embodiment of a handle oriented with mounted optic.
Figure 42:
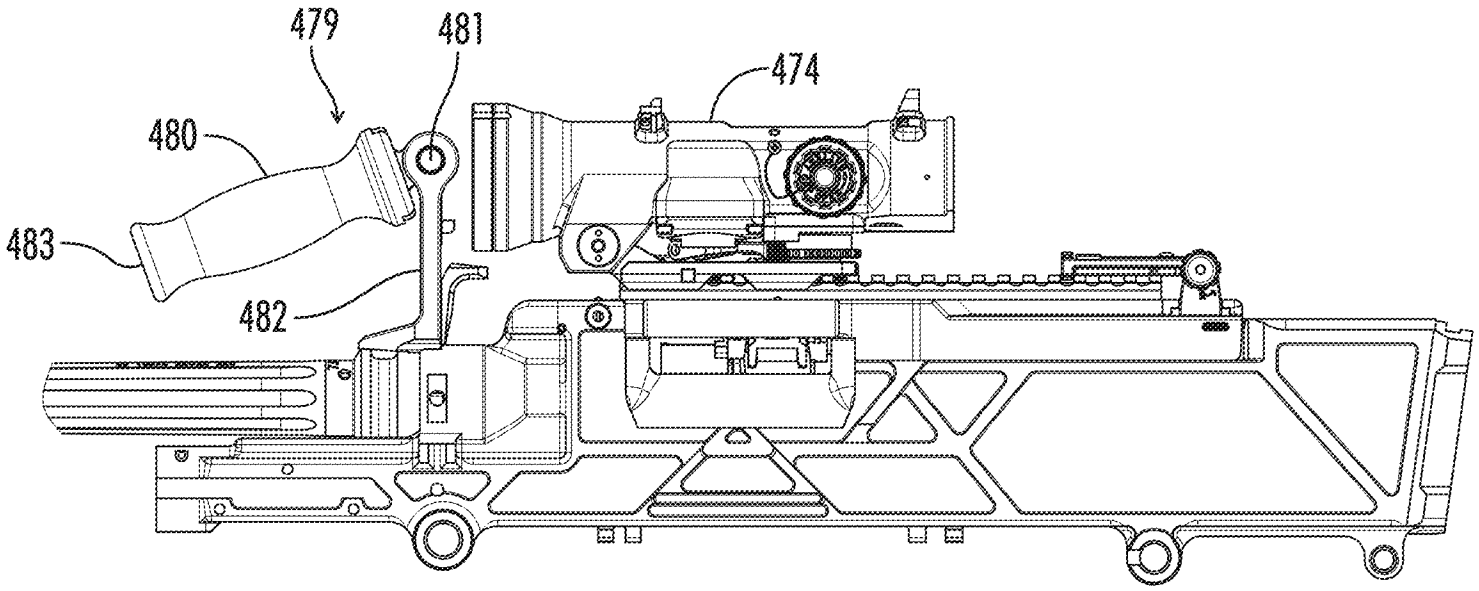
FIG. 42 is an illustration of an optional embodiment of a handle oriented with mounted optic.

In optional embodiments, attachment interface 464 may be a Picatinny rail arrangement which many be used to attach accessories, such as optics, lights, etc. to top cover 462. As illustrated, attachment interface 464 may optionally span from receiver connection point 466 to rear sight attachment 470. One of skill in the art would understand such arrangement to mean that attachment interface 464 extends from the general vicinity of receiver connection point 466 to the general vicinity of rear sight attachment 470. In other optional embodiments not illustrated, attachment interface 464 may span shorter distances on top cover 462. Advantageously, attachment interface 464 as illustrated allows for the increased flexibility in mounting accessories. For example, one could mount an optic far forward (distally) on top cover 462. Such is illustrated in FIGS. 41 and 42. Otherwise stated, a user has an increased amount of optional arrangements in setting up an M240 machine gun with the optional embodiment of the top cover as illustrated.

Furthermore, top cover 462 may optionally be a rivetless design. In such embodiments, top cover 462 may optionally be formed from a unitary piece of metal through one of a variety of known processes for producing metal components. In such embodiments, top cover 462 may include flat surfaces adjacent to the attachment interface 464, such flat surfaces designated by numeral 472. As used herein, "flat" or "smooth" generally means the surfaces are free from large obstructions as present on some prior art M240 machine gun top covers. Advantageously, flat surface 472 provides for an obstruction-free area for mounting optics. With prior art M240 machine guns, the lack of a flat surface adjacent to the attachment interface could preclude the mounting of some optics as obstructions on the top cover would spatially interfere with scope mounts or other necessary hardware. Thus, flat surface 472 may provide for greater flexibility in mounting accessories to attachment interface 464.

Figure 35:
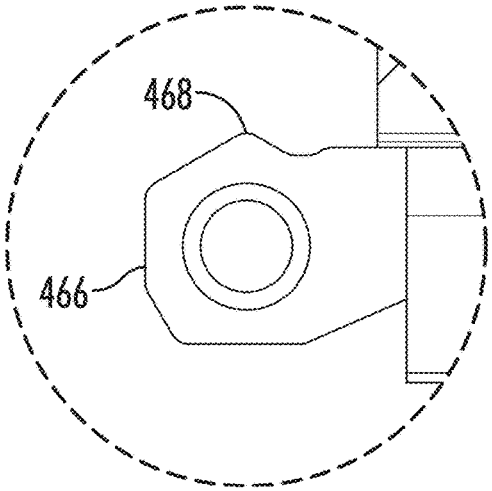
FIG. 35 is an illustration of an optional embodiment of a top cover's receiver's connection point.
Figure 38:
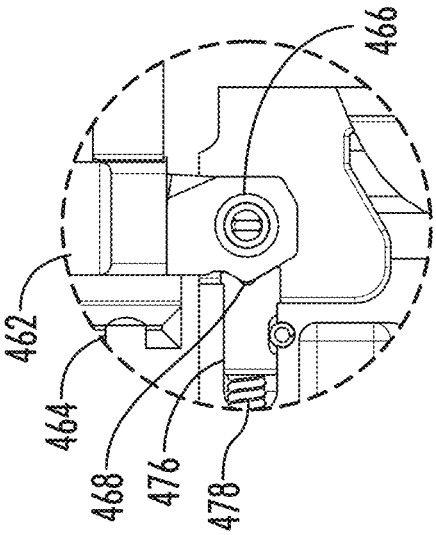
FIG. 38 is an illustration of an optional embodiment of a top cover open on a receiver in a cut-away view at the detent assembly.
Figure 37:
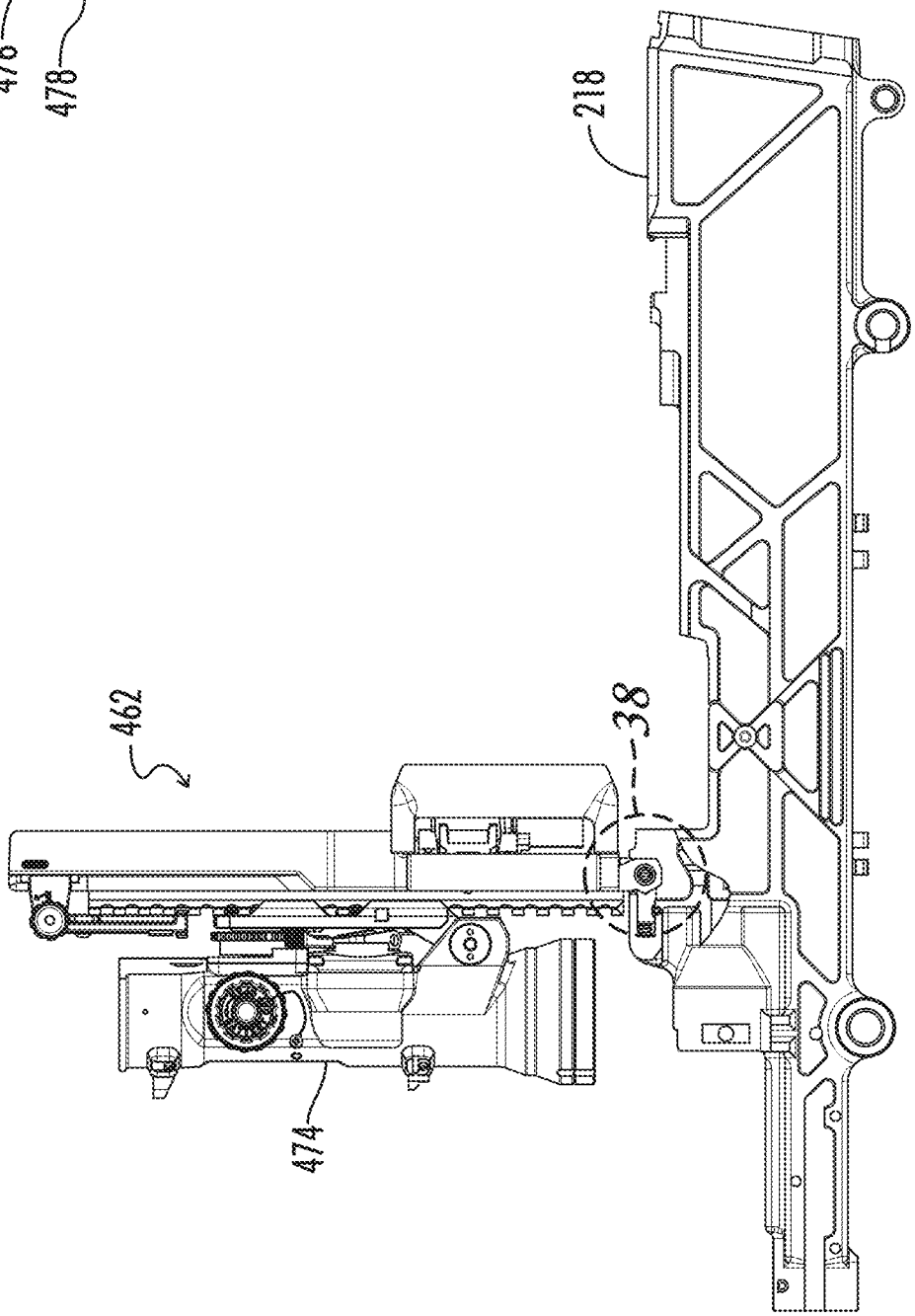
FIG. 37 is an illustration of an optional embodiment of a top cover open on a receiver.

Receiver connection point 466 of top cover 462 is used to attach top cover 462 to the receiver of an M240 machine gun toward the distal end of the receiver. As illustrated in FIG. 35, receiver connection point 466 includes detent 468. Detent 468 on receiver connection point 466 may engage within a detent assembly that may include detent pin 476 and pin spring 478 as illustrated in FIG. 38. Detent 468 many also be referred to as a positioning detent. As illustrated in FIG. 37, detent 468 may assist in maintaining top cover 462 in an open position. Advantageously, detent 468 of receiver connection point 466 may assist so a user may open top cover 462 in operating the M240 machine gun with top cover 462 being less inclined to inadvertently close shut. Especially with accessories mounted to attachment interface 464, detent 468 will provide assistance to the user to maintain top cover 462 open when desired. Traditional M240 machine guns were known to inadvertently close on the user while such user was attempting to load a belt of ammunition into the machine gun.

Referring to FIGS. 37 and 38, FIG. 37 illustrates top cover 462 with optic 474 in an open position relative to receiver 218. The cut away view of FIG. 38 illustrates detent pin 476 engaging detent 468 with spring 478 providing tension. When a user desires to move top cover 462 to a closed position, detent 468 would rotate out of engagement with detent pin 476 and thus top cover 462 could be closed on the receiver. Generally, as used herein, detent assembly refers to the combination of a detent, a pin, and a spring or its equivalent that may be used to maintain top cover 462 in a specific orientation relative to the receiver. As illustrated in FIG. 37, detent 468 allows for top cover 462 to be held at about a ninety-degree angle relative to the receiver. However, in, other optional embodiments, the detent assembly may function to assist in orienting the top cover relative to the receiver at greater or lesser angles than about ninety-degrees.

In further optional embodiments, detent 468 of receiver connection point 466 may be a notch or depression rather than a protrusion. As such, detent pin on the receiver may have a corresponding shape to engage the notch or depression in such optional embodiments. Thus, as used herein, "detent" with respect to the receiver connection point is understood to be the shaped portion of the receiver connection point that engages the pin of the detent assembly. Thus, a detent can be the shape as illustrated in FIG. 38 and indicated by numeral 468 as well as a notch or depression.

Figure 39:
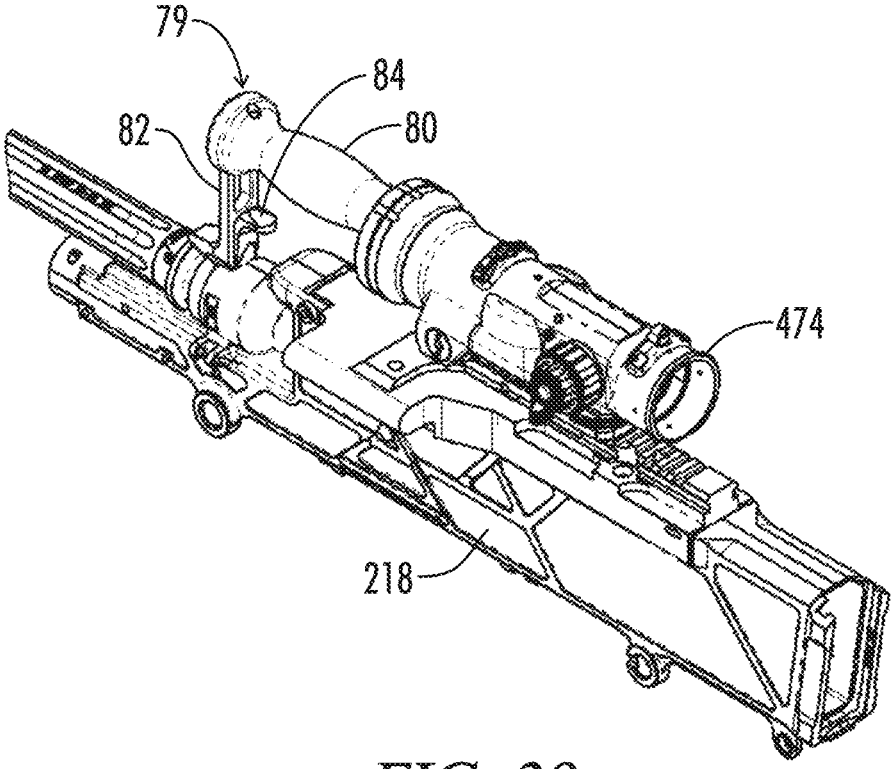
FIG. 39 (PRIOR ART)
FIG. 39 is an illustration of a prior art M240 machine gun with optic.
Figure 40:
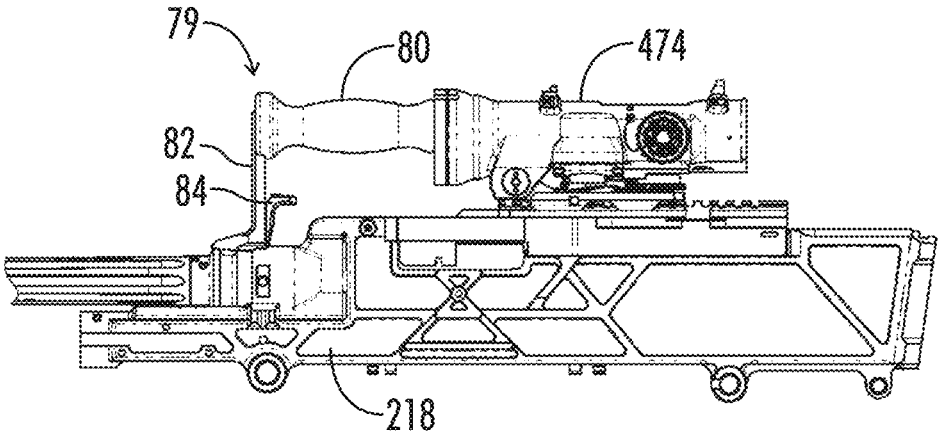
FIG. 40 (PRIOR ART)
FIG. 40 is an illustration of a prior art M240 machine gun with optic.

Referring now to FIGS. 39 and 40, there are prior art illustrations of an M240 machine gun. Specifically, this includes receiver 218, and its prior art top cover with optic 474. Also illustrated is handle assembly 79 which includes handle 80 and handle connector 82 with handle lift catch 84. Handle 80 is in a fixed position relative to handle connector 82. Generally, handle 80 is oriented in the vicinity of the right side of the M240 machine gun's receiver when the machine gun is intended to be fired. The handle assembly can be rotated upward relative to the receiver when the barrel assembly is to be removed. Additionally, the handle in the upward position, can also be considered a carry position for some embodiments of the M240 machine gun. With optics mounted to an attachment interface in prior art M240 machine guns, the optic may interfere with the rotational movement of the handle. This may be disadvantageous as one might have to remove the optic first, prior to removing the barrel assembly if such optic was in the necessary rotational path of the handle. Even if there was not a direct mechanical interference between the handle assembly, such close proximity of the handle and optic could complicate the removal of the barrel assembly from the machine gun. Alternatively, the handle would force the optic to be mounted more proximally so that necessary space would be available for the handle to rotate.

Referring now to FIGS. 41-46, there is an optional embodiment of handle assembly 479. Handle assembly 479 includes handle 480 and handle connector 482. Furthermore, handle 480 includes both connected end 481 and free end 483. Connected end 481 of handle 480 is the end of handle 480 in connection with handle connector 482 whereas free end 483 of handle 480 is not connected to handle connector 482. Advantageously, handle 480 may rotate at connected end 481. In doing so, handle 480 may be optionally oriented so as to minimize interference with optic 474 as mounted to an attachment interface of the top cover. Furthermore, handle assembly 479 allows for accessories, such as optic 474, to be mounted farther distally forward on the top cover as handle 480 can rotate out of the way of optic 474 in comparison to prior art handle 80.

Figure 43A:
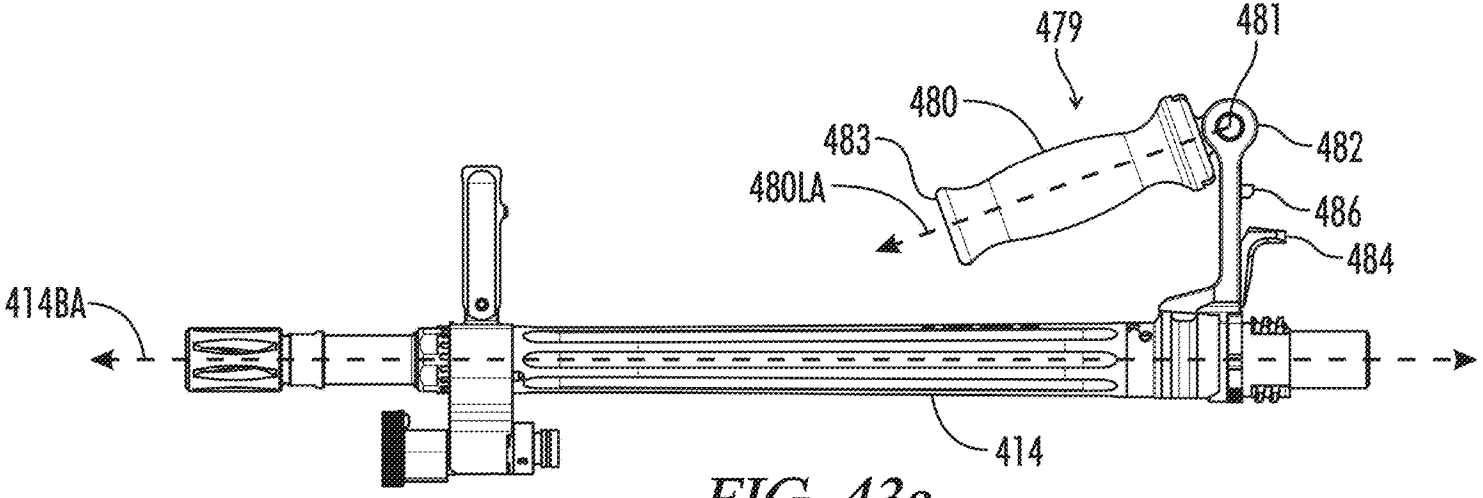
FIG. 43*a* is an illustration of an optional embodiment of a handle with the handle oriented distally.
Figure 43B:
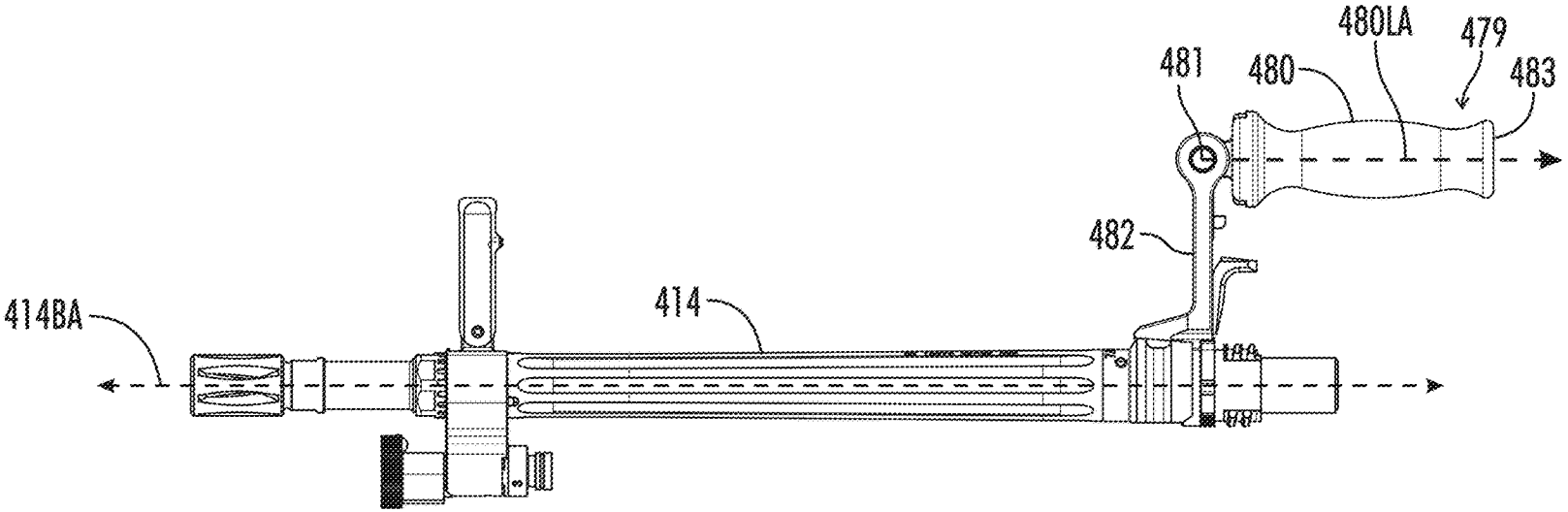
FIG. 43*b* is an illustration of an optional embodiment of a carry handle oriented with the handle oriented proximally.

Handle 480 may be operable between a variety of positions. Handle 480 may be positioned in a first position with free end 483 of handle 480 pointing proximally. Handle 480 may also be positioned in a second position with free end 483 of handle 480 pointing distally. To assist in clarifying the direction free end 483 of handle 480 points, one can consider the direction linear axis 480LA of handle 480 extends. Linear axis 480LA runs lengthwise, beginning at the center of connected end 481 and through handle 480, and out through the center of free end 483. FIG. 43*a* illustrates free end 483 of handle 480 pointing distally with linear axis 480LA and FIG. 43*b* illustrates free end 483 of handle 480 pointing proximally with linear axis 480LA.

In optional embodiments with handle 480 pointing distally, free end 483 and linear axis 480LA can be oriented to point toward barrel axis 414BA of barrel 414. As used herein, barrel axis is the axis running though and parallel with the bore of the barrel, and can be used interchangeably with the axis of the bore. Otherwise stated, one optional embodiment is handle assembly 479 with handle 480 positioned with free end 483 pointing distally with linear axis 480LA oriented to intersect barrel axis 414BA. This is illustrated in FIG. 43*a*. Alternatively, free end 483 and linear axis 480LA can be oriented to point away from barrel axis 414BA while still pointing distally. Such would occur if handle 480 was pointed slightly upward relative to barrel 414 and axis 414BA so that free end 483 and linear axis 480LA pointed slightly upward, but still in a proximal direction. In yet further optional embodiments, free end 483 and linear axis 480LA can be oriented to be parallel with barrel 414 and axis 414BA.

Similar orientations of free end 483 of handle 480 and linear axis 480LA can occur with free end 483 pointing proximally. Another optional embodiment is handle assembly 479 with a handle 480 positioned with free end 483 pointing proximally with linear axis 480LA intersecting barrel axis 414BA extending out of the proximal end of the barrel. Alternatively, free end 483 and linear axis 480LA can be oriented to point away from barrel axis 414BA while still pointing proximally. Such would occur if handle 480 was pointed slightly upward relative to an attached receiver so that free end 483 and linear axis 480LA pointed slightly upward, but still in a proximal direction. In yet a further optional embodiment, free end 483 and linear axis 480LA can be oriented to be parallel with axis 414BA. This is illustrated in FIG. 43*b*. In referencing the various orientations of handle 480, linear axis 480LA, barrel 414 and barrel axis 414BA, the described orientations are as one of skill in the art would understand such arrangements in visually observing the various components.

Referring back FIGS. 41 and 42, handle 480 is positioned so that free end 483 points distally and toward barrel 414. In such configurations where free end 483 of handle 480 points distally where linear axis 480LA would intersect barrel axis 414BA (axes are not shown in FIGS. 41 and 42), such orientation of handle 483 can be advantageous for the user. In situations where a user carries a M240 machine gun with handle assembly 479 having handle 480 oriented as in FIGS. 41 and 42, the muzzle of the barrel would point more upward than parallel to the ground. This is quite useful in helping to avoid barrel 414 from getting tangled in brush, debris or other impediments that would more likely contact the barrel if it was carried about parallel to the ground. Advantageously, it can allow a user to move more swiftly while carrying or climbing with an M240 machine gun with such orientation.

Referring back to FIGS. 43*a* and 43*b*, there are illustrations of handle assembly 479 affixed to a barrel. As mentioned previously, FIG. 43*a* illustrates handle assembly 479 with handle 480 having its free end 483 pointing distally and FIG. 43*b* illustrates handle assembly 479 with handle 480 having its free end 483 pointing proximally. The receiver and other components have been removed to more clearly illustrate handle assembly 479 and different positions of handle 480. Additionally, these two figures also illustrate handle connector 482, lift catch 484 and push button 486. Push button 486 can be used to rotate handle 480 of handle assembly 479 from pointing distally as illustrated in FIG. 43*a* to FIG. 43*b* wherein free end 483 of handle 480 points proximally. Otherwise stated, handle 480 of handle assembly 479 can fold forward or rearward. To allow for handle 480 to alternate between a forward (distally pointing) and rearward (proximally pointing) position, push button 486 is engaged by the user. Lift catch 484 is used to unlock and rotate handle assembly 479 from a carry position to a position wherein handle is in the vicinity of the right side of the receiver.

Figure 44:
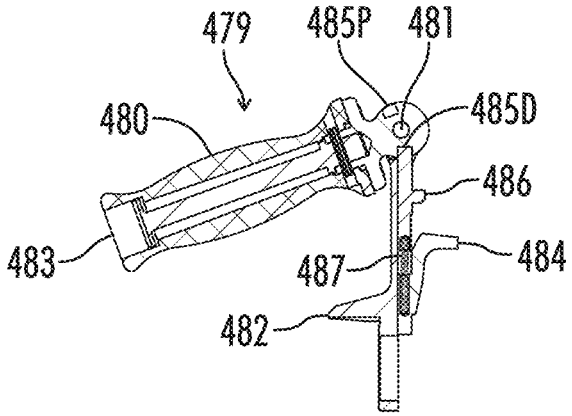
FIG. 44 is an illustration of an optional embodiment of a cut-away view of a handle.
Figure 45:
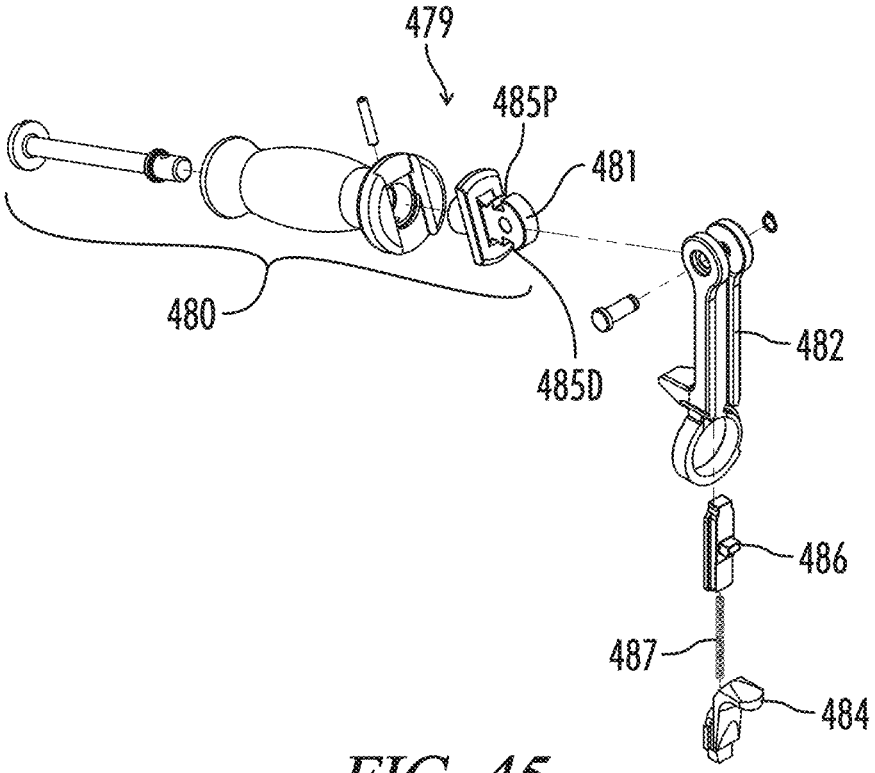
FIG. 45 is an illustration of an optional embodiment of a exploded view of a handle.

Referring now to FIGS. 44 and 45, there are illustrations of a cut-away view of handle assembly 479 and an exploded view of handle assembly 479. In such illustrations, spring 487 is visible which applies tension to push button 486 to engage notches 485P and 485D on handle 480. More specifically and in the optional embodiment as illustrated, handle 480 includes two notches 485P and 485D, each notch corresponding to a position of handle 480. For example, FIG. 44*a* illustrates push button 486 engaging notch 485D corresponding to handle 480 having free end 483 pointing distally if handle assembly 479 was configured on a barrel. Engaging notch 485P with push button 486 would result in handle 480 having its free end 483 pointing proximally. FIG. 45, with the exploded view, provides for further visuals as to how handle assembly 479 is assembled. As is illustrated, handle 480 rotates at connected end 481 about handle connector 482 so long as push button 486 is engaged to withdraw it from either of notches 485D and 485P of handle 480. In further optional embodiments, lesser or greater numbers of notches may be present which would correspond to different orientations of handle 480.

Figure 46:
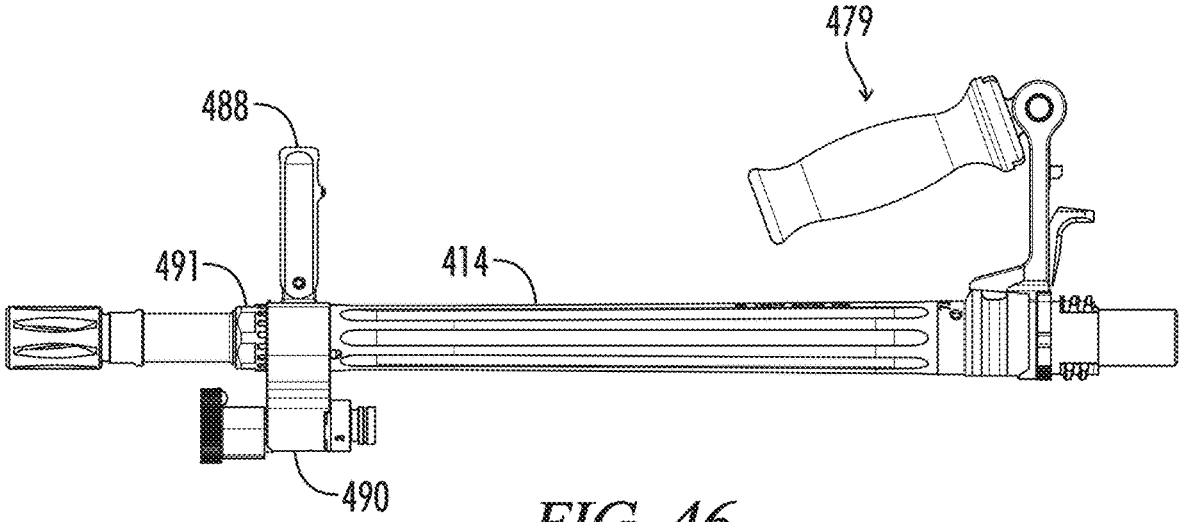
FIG. 46 is an illustration of an optional embodiment of a barrel assembly with gas block.
Figure 47A:
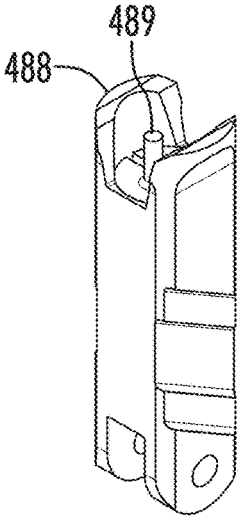
FIG. 47*a* is an illustration of an optional embodiment of a front sight.
Figure 47B:
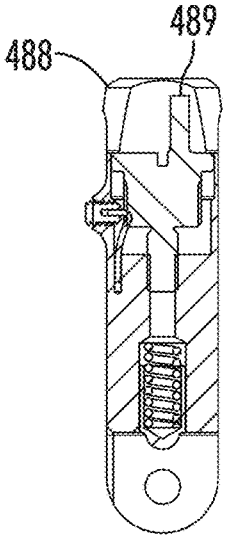
FIG. 47*b* is an illustration of an optional embodiment of a cut-away view of a front sight.

Referring now to FIGS. 46, 47*a*, and 47*b*, there are illustrations of an optional embodiment of gas block 490 with front sight 488. Front sight 488 can optionally be positioned between an erect and folded position so as to prove the user with an unobstructed view when using an optic. Front sight 488 includes front sight post 489 which may optionally be adjustable both left and right, as well up and down.

Figure 48:
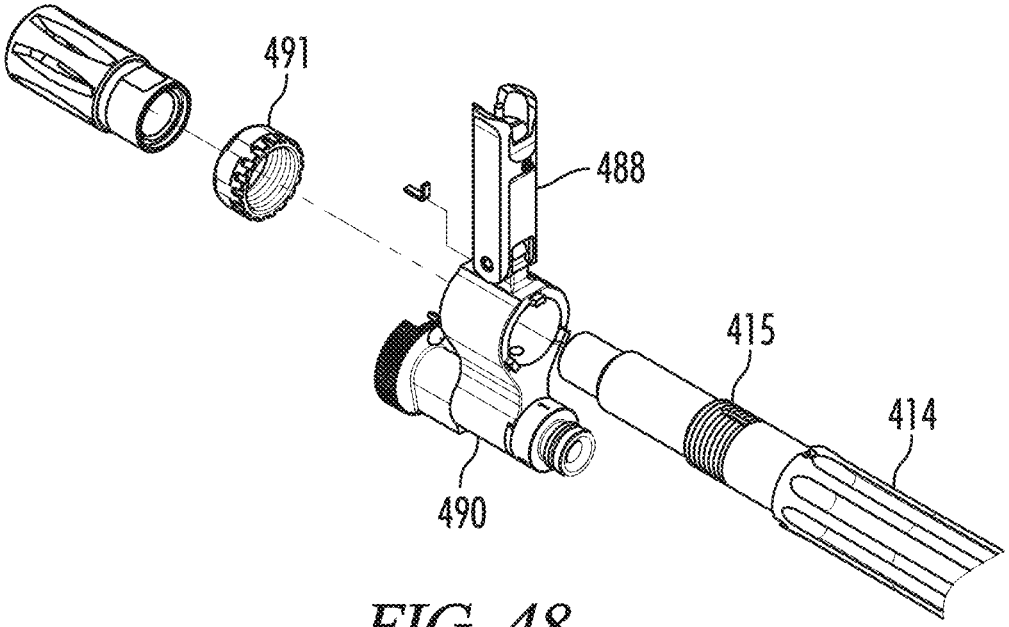
FIG. 48 is an illustration of an optional embodiment of an exploded view of a gas block assembly.

Additionally, as illustrated in both FIG. 46 and FIG. 48, front sight 488 may optionally be integrated with gas block 490 for barrel 414. As such, gas block 490 and front sight 488 are removed from or installed on barrel 414 together. In these optional embodiments, gas block 490 is secured to barrel 414 via gas block retainer 491. Gas block retainer 491 may include internal threads which correspond and thread to barrel threads 415. As such, when barrel 414 needs to be replaced, gas block 490 can be removed after unscrewing gas block retainer 491 and then reinstalled on a new barrel. Advantageously, front sight 488 and gas block 490 may be reused whereas in many prior art M240 machine gun arrangements, the gas block and front sight are scrapped with the barrel as often the gas block is press fit and pinned in place. Furthermore, by incorporating front sight 488 on gas block 490, weight that would otherwise be mounted toward the distal end of the barrel is moved proximally, minimizing distal weight.

Figure 49A:
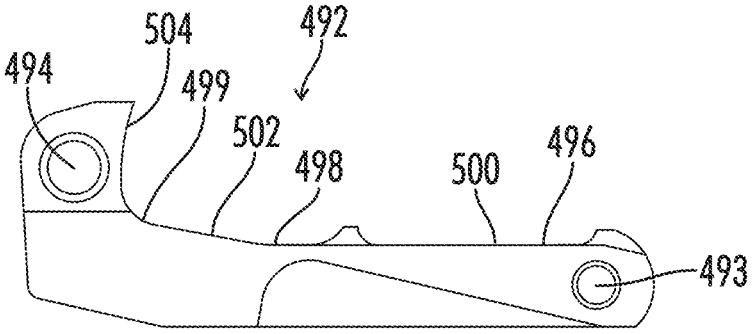
FIG. 49a (PRIOR ART)
FIG. 49*a* is an illustration of a prior art locking lever.
Figure 49B:
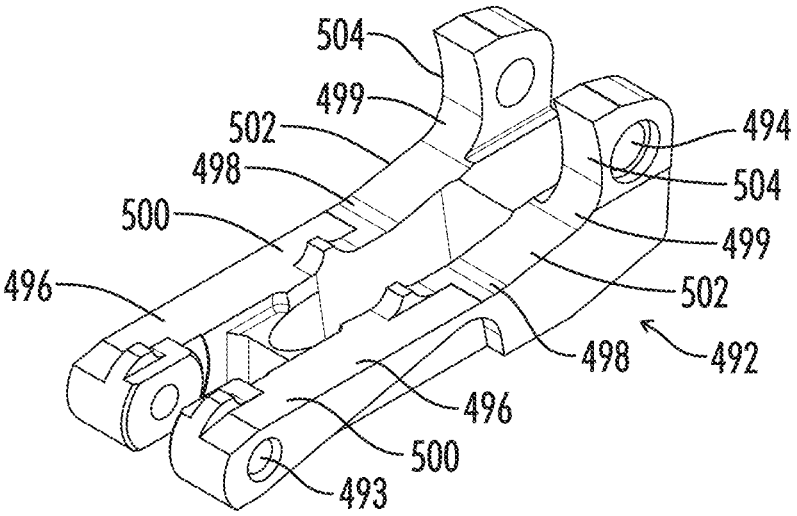
FIG. 49b (PRIOR ART)
FIG. 49*b* is an illustration of a prior art locking lever.

Referring now to FIGS. 49*a*, 49*b*, there is an illustration of a prior art locking lever, indicated by numeral 492. Generally, the bolt assembly of a M240 machine gun rides with locking lever 492. In addition to being in communication with the bolt assembly at bolt end 493, locking lever 492 is also in communication with operating rod assembly at proximal end 494. In closing the action of a M240 prior art machine gun, locking lever 492 is forced downward at proximal end 494 upon pressure from the operating rod assembly. Within the internals of a prior art receiver (not shown), locking lever 492 engages an internal guide within the receiver at a high rate of speed due to the operation of the machine gun. Locking level 492 has two contact surfaces 496, each generally parallel to the other as illustrated in FIG. 49*b*. Each contact surface 496 of prior art locking lever 492 has two apexes, one apex indicated by numeral 498 and the second apex indicated by numeral 499 As used herein, apex refers to the sharpest point of a curve or corner.

More specifically, locking lever 492 includes apex 498 between the transition of flat portion 500 and angled flat portion 502 of contact surface 496. During operation, locking lever 492 contacts the receiver at about the flat portion 500 of contact surface 496 and continues contact with the internal receiver elements to about apex 498 where flat portion 500 transitions to angled flat portion 502 of contact surface 496. Upon contacting apex 498, locking lever 492 forcefully moves, resulting in lack of contact with the receiver until after about apex 499 at curved portion 504 of contact surface 496 of locking lever 492. Such forceful and abrupt contact between receiver and locking lever can result to receiver failure and eventual unreliability.

Figure 50:
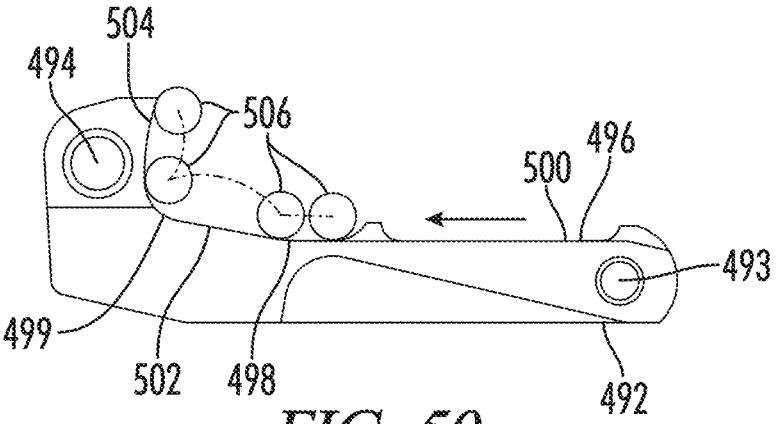
FIG. 50 (PRIOR ART)
FIG. 50 is an illustration of a prior art locking lever showing contact with a receiver guide.

FIG. 50 schematically illustrates the receiver contacting locking lever 492 with elements of the locking lever intentionally not shown to better illustrate the nature of contact between the receiver and locking lever 492. Locking lever 492 engages the internal guide of the receiver which is represented by the circles and is indicated by numeral 506. The line connecting the circles represents the orientation of internal guide 506 relative to locking lever 492 as locking lever 492 moves relative to internal guide 506. Contact surface 496 engages internal guide 506 on flat portion 500 until about apex 498 at about the point where flat portion 500 of contact surface 496 of locking lever 492 transitions to ramp portion 502 of contact surface 496 of locking lever 492. Contact with receiver guide 506 is reestablished briefly on curved surface 504 near apex 499 of contact surface 496. Locking lever 492 may lose contact with internal guide 506 again on curved surface 504 as locking lever 492 further moves. Such bouncing in and out of contact with internal guide 506 creates added stress on the prior art machine gun.

Figure 51A:
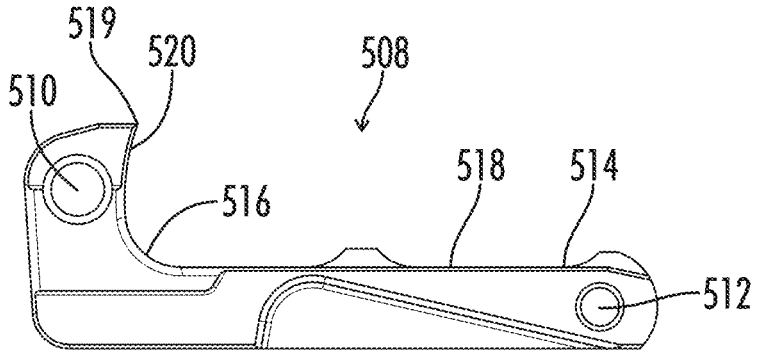
FIG. 51*a* is an illustration of an optional embodiment of a locking lever.
Figure 51B:
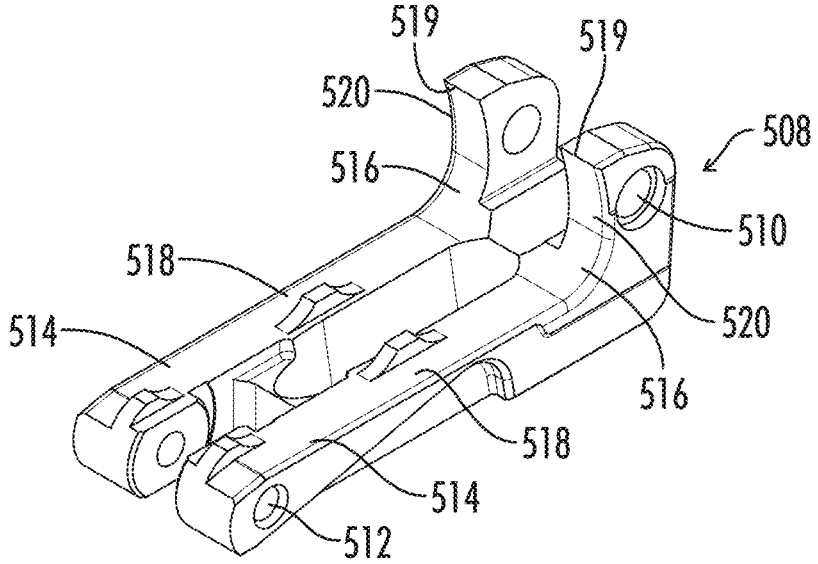
FIG. 51*b* is an illustration of an optional embodiment of a locking lever.
Figure 52:
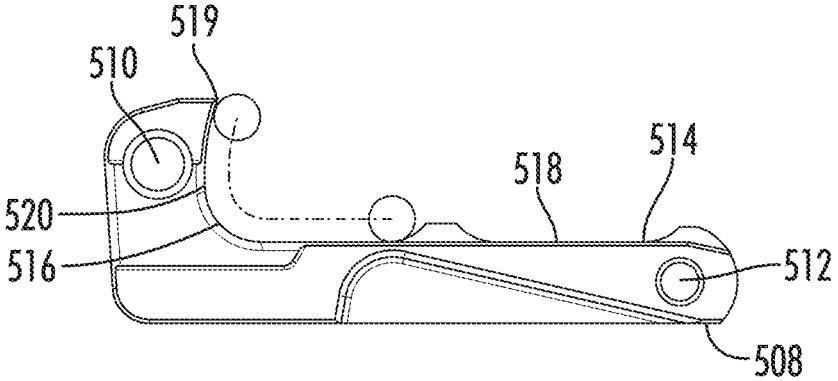
FIG. 52 is an illustration of an optional embodiment of a locking lever showing contact with a receiver guide.

Referring now to FIGS. 51*a*, 51*b*, and 52, there is an optional embodiment of locking lever 508. Locking level 508 includes proximal end 510, distal end 512 and contact surfaces 514. Each contact surface 514 of locking lever 508 includes flat portion 518, apex 516 and curved portion 520. Advantageously, locking lever 508 has only one apex on each contact surface 514. Otherwise stated, each contact surface 514 has flat portion 518 gradually and smoothly transitioning to curved portion 520 so the only apex is in curved portion 520. The only apex 516 on each contact surface 514 is about beneath terminal end 519 of curved portion 520 of contact surface 514. Additionally, apex 516 of each contact surface 514 of locking lever 508 is located in about the same proximal position as terminal end 519 when oriented as in FIG. 51*a* which is generally as when locking lever 508 is laid on a flat surface. Due to this design of locking lever 508, locking lever 508 remains in contact with a receiver's internal guide resulting in locking lever 508 being guided to a lowered position in a more controlled manner.

FIG. 52 schematically illustrates the receiver contacting locking lever 508 with elements of locking lever 508 intentionally not shown to better illustrate the nature of contact between the receiver and locking lever 508. Locking lever 508 engages the internal guide of the receiver which is represented by the circles and is indicated by numeral 520. The line connecting the circles represents the orientation of internal guide 520 relative to locking lever 508 as locking lever 508 moves relative to internal guide 520. Contact surface 514 engages internal guide 520 on flat portion 518. Internal guide 520 stays in contact with contact surface 514 as contact surface 514 transitions from flat portion 518 to curved portion 520. Otherwise stated, internal guide 520 stays in contact with contact surface 514 as locking lever 508 lowers with contact maintaining through apex 516. As a result, locking lever 508 transfers lesser amounts of forceful impacts than prior art locking lever 492.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful Firearm System, it is not intended that such references be construed as limitations upon the scope of this invention except as set forth in the following claims

What is claimed is:

1. An M240 machine gun barrel assembly comprising:

a barrel with a muzzle end at the distal end of the barrel and a breach end at the proximal end of the barrel, the barrel having at least one detent formed therein;

a removable gas block with a front sight attached to the gas block, the gas block comprising at least one tab configured to engage the detent so as to align the gas block and the front sight with the barrel; and a gas block retainer for retaining the gas block on the barrel of the barrel assembly.

2. The M240 machine gun barrel assembly of claim 1 wherein the gas block retainer further comprises internal threads to correspond to external barrel threads to retain the gas block.

3. The M240 machine gun barrel assembly of claim 1 wherein the front sight is adjustable between a folded position and an erect position.

4. The M240 machine gun barrel assembly of claim 3 wherein the front sight further comprises a sight post adjustable left and right and up and down.

5. An M240 machine gun comprising the M240 machine gun barrel assembly of claim 1.

* * * * *